US009664477B1

(12) United States Patent
Reavis, III

(10) Patent No.: US 9,664,477 B1
(45) Date of Patent: May 30, 2017

(54) HANDGUN BRACE

(71) Applicant: Johnson Paul Reavis, III, Christiana, TN (US)

(72) Inventor: Johnson Paul Reavis, III, Christiana, TN (US)

( * ) Notice: Subject to any disclaimer, the term of this patent is extended or adjusted under 35 U.S.C. 154(b) by 0 days.

(21) Appl. No.: 15/407,362

(22) Filed: Jan. 17, 2017

Related U.S. Application Data

(60) Provisional application No. 62/279,201, filed on Jan. 15, 2016, provisional application No. 62/327,219, filed on Apr. 25, 2016.

(51) Int. Cl.
*F41C 23/12* (2006.01)
*F41C 27/22* (2006.01)
*F41A 23/02* (2006.01)

(52) U.S. Cl.
CPC ..... *F41C 23/12* (2013.01); *F41A 23/02* (2013.01); *F41C 27/22* (2013.01)

(58) Field of Classification Search
CPC ..... F41C 23/10; F41C 23/14; F41C 23/12; F41C 23/04; F41C 23/20; F41C 27/22
See application file for complete search history.

(56) References Cited

U.S. PATENT DOCUMENTS 3,184,877 A * 5/1965 Andrews ..... F41C 23/12 42/72
3,209,481 A * 10/1965 Gilbert ..... F41C 23/00 42/71.01
3,324,588 A * 6/1967 Gilbert ..... F41C 23/00 42/71.01
3,442,042 A * 5/1969 Gilbert ..... F41C 23/00 42/71.01
4,291,482 A * 9/1981 Bresan ..... F41C 23/14 42/72
4,296,566 A * 10/1981 Campos ..... F41C 23/14 42/71.01
4,790,095 A * 12/1988 Campos ..... F41C 23/00 42/71.01

(Continued)

OTHER PUBLICATIONS

Shockwave Technologies, the "Blade" Pistol Brace, http://shockwavetechnologies.com/site/?page_id=2316 (last accessed Jan. 16, 2017).

(Continued)

*Primary Examiner* — Benjamin P Lee
(74) *Attorney, Agent, or Firm* — Eric B. Fugett; Waller Lansden Dortch & Davis, LLP

(57) ABSTRACT

A handgun brace for stabilizing a handgun on a user's forearm includes a body adapted to detachably engage a support structure such as a receiver extension extending rearwardly out of the rear end of a handgun, a first arm extending generally downwardly from the body, and a second arm pivotally connected to the first arm. The second arm is selectively moveable between a stowed position wherein and end of the second arm is received against a side of the body, and a deployed position wherein the first arm and the second arm form a downwardly rigid forearm support structure under the body. The forearm support structure includes a continuous support surface upon which a user's forearm is removably receivable to stabilize the handgun when the body is engaged with the support structure of the handgun.

20 Claims, 27 Drawing Sheets

(56) References Cited

U.S. PATENT DOCUMENTS

| | | | | |
|---|---|---|---|---|
| 5,778,588 | A * | 7/1998 | Allen, III | F41C 23/12 42/71.02 |
| 6,016,620 | A * | 1/2000 | Morgan | F41C 27/00 42/94 |
| 6,250,009 | B1 * | 6/2001 | Leontuk | F41A 27/22 42/72 |
| 7,028,427 | B2 * | 4/2006 | Crawford | F41C 33/001 42/72 |
| 8,051,596 | B1 * | 11/2011 | Thomas, Jr. | F41C 33/001 224/150 |
| 8,109,026 | B1 * | 2/2012 | Bentley | F41C 23/04 42/73 |
| D706,896 | S | 6/2014 | Bosco | |
| 8,869,444 | B2 | 10/2014 | Bosco | |
| 8,910,407 | B2 * | 12/2014 | Singh | F41C 23/06 42/71.02 |
| D728,724 | S | 5/2015 | Bosco | |
| D745,941 | S | 12/2015 | Bosco et al. | |
| 9,354,021 | B2 | 5/2016 | Bosco | |
| D764,622 | S | 8/2016 | Bosco et al. | |
| 9,453,699 | B1 * | 9/2016 | Barnett | F41B 5/123 |
| 9,459,073 | B1 * | 10/2016 | Kloeppel | F41C 23/20 |
| D774,618 | S | 12/2016 | Bosco et al. | |
| D780,279 | S * | 2/2017 | Bosco | D22/108 |
| 2009/0049731 | A1 * | 2/2009 | Seuk | F41A 23/16 42/94 |
| 2014/0053447 | A1 * | 2/2014 | Singh | F41C 23/06 42/71.02 |
| 2014/0144061 | A1 * | 5/2014 | Bosco | F41C 33/001 42/94 |
| 2016/0265872 | A1 * | 9/2016 | Tarazi | F41C 27/22 |
| 2016/0282084 | A1 * | 9/2016 | Hollis | F16M 13/04 |

OTHER PUBLICATIONS

Franchi SPAS 12 Shotgun Manual.

* cited by examiner

HANDGUN BRACE

CROSS-REFERENCES TO RELATED APPLICATIONS

This application claims priority to and hereby incorporates by reference in their entirety U.S. Provisional Patent Application Ser. No. 62/279,201 entitled "ARM BRACE DEVICE FOR A FIREARM," filed on Jan. 15, 2016, and U.S. Provisional Patent Application Ser. No. 62/327,219 entitled "ARM BRACE AND LATCH ASSEMBLY FOR A FIREARM," filed on Apr. 25, 2016.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to a stabilizing device for a handgun and, more particularly, to a handgun brace that receives and engages the user's forearm to stabilize the handgun during firing.

The accuracy, speed, and precision with which a handgun can be reliably fired depend greatly upon the user's ability to hold the handgun steady while aiming and discharging it. This can be particularly challenging for physically disabled persons who cannot firmly grip or steady a handgun for a period of time sufficient to accurately fire the handgun. The difficulty of holding a handgun in a steady position is heightened during one-handed operation because a user must bear much of the weight and recoil of the handgun with the wrist of one hand, which can cause the user's hand and wrist to tire prematurely and negatively impact the user's ability to safely and reliably handle and fire the handgun. This problem is further increased with large frame handguns in which the weight of the handgun is centered at a location forward of the grip because such handguns require the user to continuously exert a counterbalancing force on the grip to maintain the handgun in a steady firing position and prevent the muzzle of the handgun from tilting downward.

A number of devices designed to attach to a handgun to aid a user in holding or stabilizing the handgun are known. For example, U.S. Pat. No. 8,869,444 discloses an flexible cuff that attaches to a handgun and employs a pair of elongated spaced flaps between which a user's forearm is secured with an adjustable securement strap to help stabilize the handgun during firing. However, the flaps apply oppositely directed inward forces to grip a user's forearm, which can chafe the user's forearm during prolonged use, while the strap requires the use of a second hand to operate, which introduces an undesirable degree of complexity that may be difficult for physically disabled users to overcome.

By contrast, the device marketed at the time of filing as the SHOCKWAVE® Blade Pistol Stabilizer employs a vertical stabilizing fin that rests against the inside of a user's forearm to stabilize an attached handgun during firing. Although designed with apertures through which a standard rifle sling may optionally be threaded to secure the fin to the user's forearm, in the absence of an accompanying sling or securement strap, the device relies solely on friction between the user's forearm and the fin to stabilize the handgun vertically during firing, which may be insufficient to adequately stabilize large frame handguns.

Accordingly, what is need are improvements in stabilizing devices for handguns.

SUMMARY OF THE INVENTION

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The presently disclosed subject matter overcomes some or all of the above-identified deficiencies of the prior art, as will become evident to those of ordinary skill in the art after a study of the information provided in this document.

Accordingly, in one aspect, the present disclosure provides a handgun brace for stabilizing a handgun on a user's forearm, the handgun brace including a body adapted to detachably engage a support structure of a handgun, such as an integral receiver extension. The handgun brace further includes a first arm extending from the body, and a second arm pivotally connected to the first arm such that the second arm is moveable between an open position and a closed position. When the second arm is in the closed position, a portion of the second arm is received against a portion of the body opposite the first arm. When the second arm is in the open position, the first arm and the second arm form a support surface shaped to receive and engage a user's forearm such that the user's forearm is removably receivable against the support surface to stabilize the handgun when the body is engaged with the support structure of the handgun.

In another aspect, the disclosure provides a telescopic handgun brace for stabilizing a handgun having a support structure extending rearwardly from a rear end thereof on a user's forearm. The handgun brace includes a mounting body having a front end, a rear end, a main passage extending axially within said body through at least the front end thereof, and at least one secondary passage extending axially through said body from said front end to said rear end, the support structure of said handgun being receivable by said main passage, and a main body having a front end, a rear end, and at least one rod extending forwardly from the front end of the main body, said at least one rod being telescopically receivable by said at least one secondary passage of the mounting body. The handgun brace can further have a first arm extending downwardly from said main body, and a second arm pivotally connected to the first arm. The second arm is selectively moveable between a stowed position wherein a portion of the second arm is received against the main body, and a deployed position wherein said first arm and said second arm form a support surface upon which a user's forearm is received during discharge of the handgun while said handgun brace is attached thereto.

In yet another aspect, the disclosure provides a telescopic handgun brace for stabilizing a handgun on a user's forearm, the handgun brace including a support structure having a forward end adapted to be detachably engaged with a rear end of a handgun, a rearward end opposite the forward end, a length, and a downwardly protruding rib extending longitudinally along a portion of the length, the rib having a plurality of cross notches formed in a side thereof. The handgun brace also includes a body having a front end, a rear end, a passage extending axially within the body through at least the front end thereof, said support structure being telescopically receivable by said passage; a forearm support member in which a user's forearm is removably receivable to stabilize the handgun when the rearward end of the support structure is received in said passage and the forward end is engaged with the rear end of said handgun, said forearm support member extending from said body; and a push-button locking latch extending laterally through a portion of the body, said latch adapted to releasably engage at least one of said cross notches to selectively lock said body in one of a plurality of positions relative to the support structure.

Numerous other objects, advantages and features of the present disclosure will be readily apparent to those of skill in the art upon a review of the following drawings and description of a preferred embodiment.

DETAILED DESCRIPTION OF THE INVENTION

Figure 1:
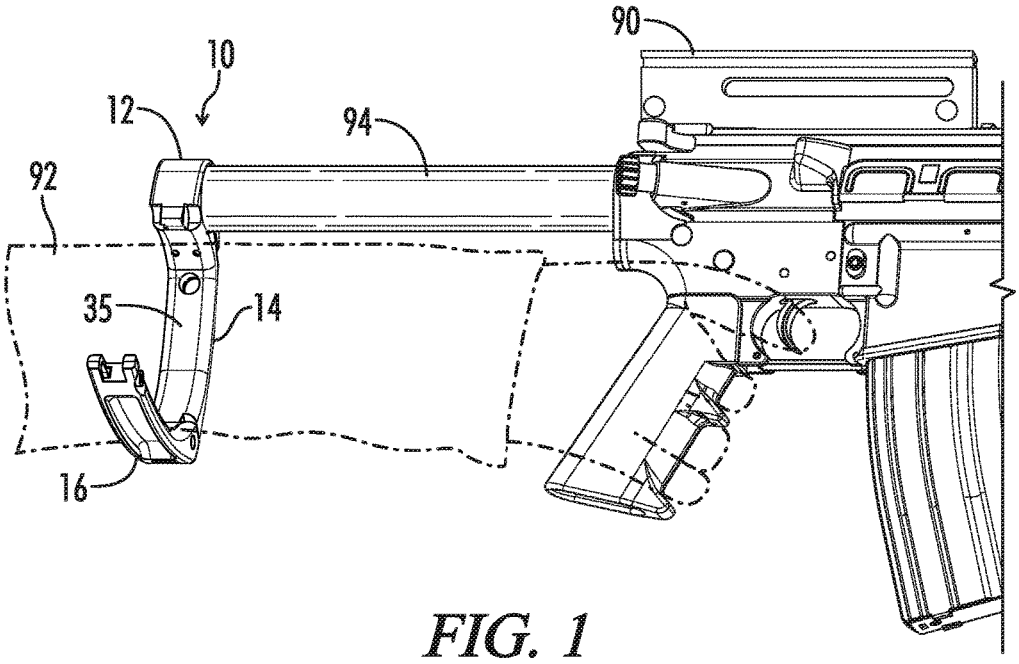
FIG. 1 is a side elevational view of an embodiment of a handgun brace constructed in accordance with the present disclosure showing the handgun brace in use and attached to a handgun.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The term "when" is used to specify orientation for relative positions of components, not as a temporal limitation of the claims or apparatus described and claimed herein unless otherwise specified. The term "lateral" denotes a side to side direction when facing the "front" of an object.

In the drawings, not all reference numbers are included in each drawing, for the sake of clarity. In addition, positional terms such as "vertical," "horizontal," "above," "below," "upper," "lower," "side," "top," "bottom," and other orientation terms refer to the apparatus when in the orientation shown in the drawing. A person of skill in the art will recognize that the apparatus can assume different orientations when in use.

Turning now to the drawings, wherein like reference numbers refer to like elements, there is illustrated in FIGS. 1 through 10 an embodiment of a handgun brace 10 mountable to a handgun 90 to assist a user in stabilizing the handgun on a user's forearm 92 without straining the user's arm, hand, or wrist. The handgun brace 10 aids a user in stabilizing a handgun in both vertical and horizontal planes with only one hand by releasably engaging two adjacent sides of the user's forearm with a selectively deployable, directionally rigid forearm support member 34 to simultaneously counterbalance the weight of the handgun and reduce lateral rotation of the handgun around the grip. In this way, the handgun brace 10 can counteract the forward tilt exhibited by large and front heavy handguns 90 due to the weight of such weapons being centered at a location forward of their grip, as well as recoil forces generated by a handgun during firing and other commonly encountered environmental forces, such as crosswinds. The handgun brace 10 provides greater and more consistent steadying support than friction alone, without the use of complicated securement straps or uncomfortably tight cuffs that can restrict a user's range of motion. Quickly and easily operable with only one hand, the handgun brace 10 is particularly advantageous for persons who require assistance or otherwise have difficulty with firmly gripping or steadying a handgun for a sufficient period of time to accurately fire the handgun.

The handgun brace 10 comprises a body 12, a first arcuate arm 14 extending from the body 12, and a second arcuate arm 16 pivotally connected to an end of the first arm 14 opposite the body 12. The body 12 includes a front end 18, a rear end 20 opposite the front end 18, opposing left and right sides 11, 13 extending between the front end 18 and the rear end 20, and a passage 19 extending axially completely through the body 12 between the front end 18 and the rear end 20. Passage 19 provides for telescopic insertion therein of a portion of a handgun 90 to secure or mount the handgun brace 10 to the handgun. As shown in FIG. 1, a handgun 90 can include a receiver extension 94 or similar support structure that extends rearwardly from a rear end of the handgun 90. The handgun brace 10 is mounted or secured to the receiver extension 94 of the handgun 90 by inserting the receiver extension 94 through the passage 19 from the front end 18 of the body 12. The body 12 is sized to permit the receiver extension 94 to extend completely though the passage 19 and outwardly from the rear end 20 of the body 12. This is desirable in order to enable a user to selectively mount the handgun brace 10 at any location along the length of the receiver extension 94 suited to the length of the user's forearm or personal preference. The body 12 is formed as an upwardly extending lobe including a selectively releasable clamping member 22 and one or more clamp screws 24 operable to retain the receiver extension 94 in the passage 19. Other suitable means of retaining the receiver extension 94 in the passage 19, including but not limited to a set screw, will be apparent to those of ordinary skill in the art and are encompassed within the scope of the invention.

It is to be understood that the handgun brace 10 is mountable to handguns that do not include a receiver extension 94 such as that depicted in FIG. 1. The handgun brace 10 is mountable to any handgun having a generally cylindrical support structure extending rearwardly from a rear end of the handgun by telescopically receiving the support structure in the passage 19. It is also contemplated that a suitable support structure comprising a cylindrical or tubular member receivable in the passage 19 can be provided for attachment to a handgun that otherwise lacks a generally cylindrical support structure upon which the handgun brace 10 may be mounted. For example, a support structure receivable in the passage 19 to mount or secure the handgun brace 10 to a handgun that does not natively include a receiver extension 94 or similar support structure can comprise a spud secured to the rear end of the handgun. In other implementations, a support structure receivable in the passage 19 to mount or secure the handgun brace 10 to a handgun that does not natively include a receiver extension 94 or similar support structure can comprise a spud secured to a mounting bracket that is secured to the rear end of the handgun. Once secured directly or indirectly to the rear end of the handgun, the spud can provide a suitable support structure to which the handgun brace 10 may be attached by receiving the spud within the passage as previously disclosed with respect to receiver extension 94.

Figure 2:
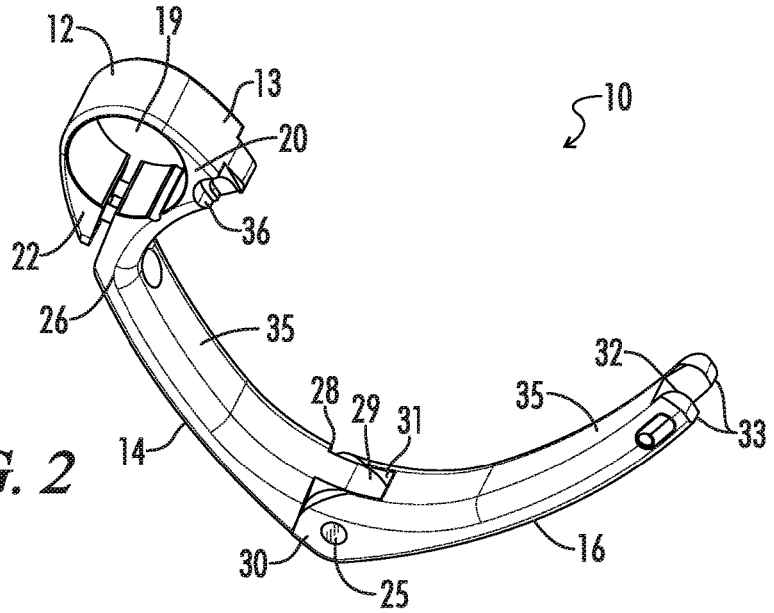
FIG. 2 is perspective view of the handgun brace of FIG. 1.
Figure 10:
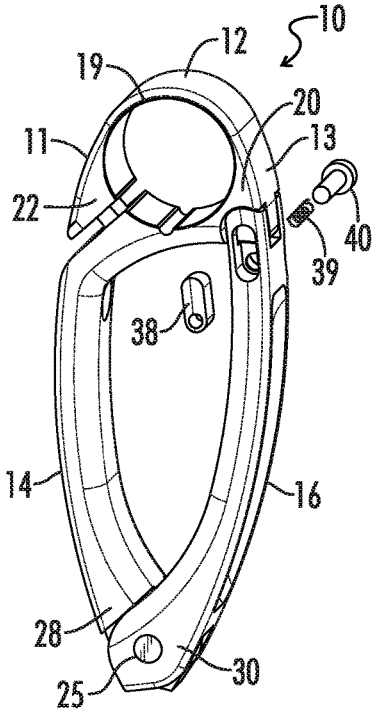
FIG. 10 is a partially exploded perspective view of the handgun brace of FIG. 1 in a non-use configuration.

The first and second arms 14, 16 of handgun brace 10 each have a proximal end 26, 30 opposite a distal end 28, 32. The first arm 14 is coupled at its proximal end 26 to a side 11 of the body 12, and extends generally downward from the body 12 such that the distal end 28 of the first arm 14 is positioned below the body 12. The distal end 28 of the first arm 14 includes a projection 29, and the proximal end 30 of the second arm 30 includes a recess 31 in which the projection 29 is received. The second arm 16 is pivotally connected at its proximal end 30 to the distal end 28 of the first arm 14 opposite the body 12 by pivot pin 25 to form a knuckle joint such that the second arm 16 is selectively moveable between an open (i.e., deployed) position as best shown in FIG. 2, and a closed (i.e., non-use or stowed) position as best shown in FIG. 10. In a particularly embodiment, pivot pin 25 is a roll pin.

Figure 3:
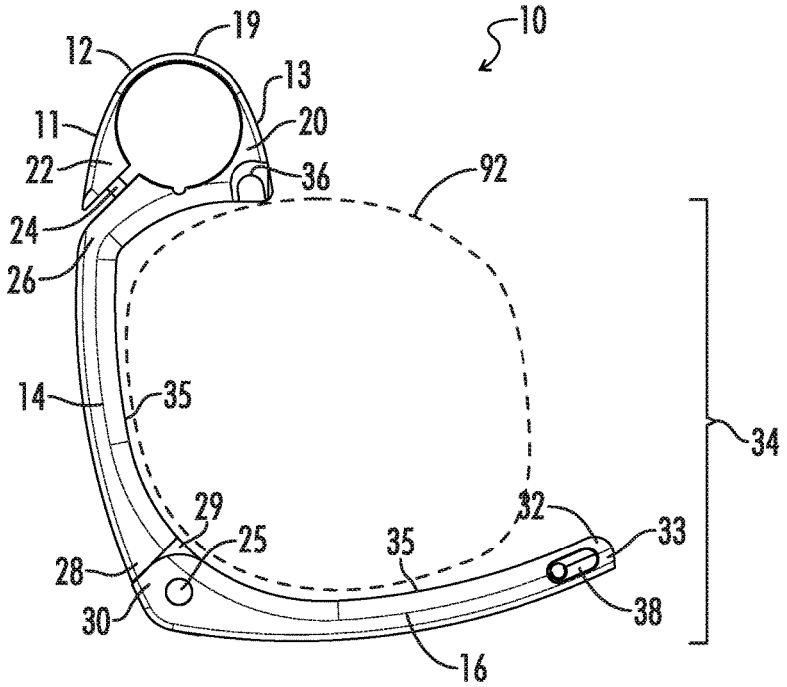
FIG. 3 is a rear elevational view of the handgun brace of FIG. 1 illustrating the handgun brace's engagement with a user's forearm.
Figure 4:
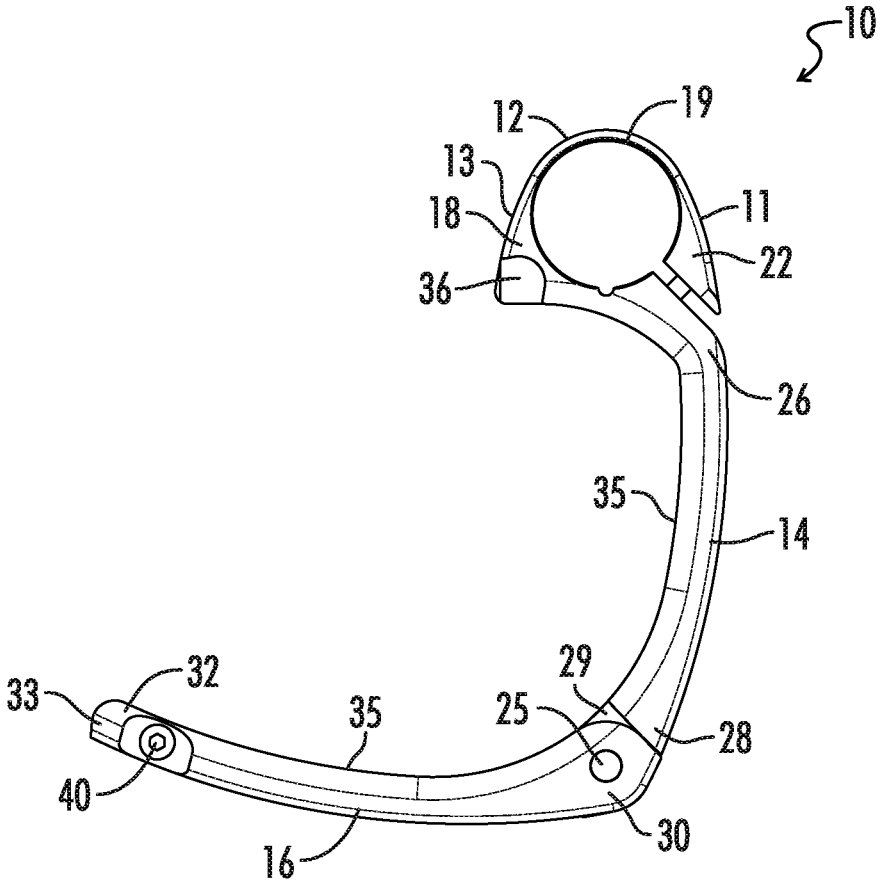
FIG. 4 is a front elevational view of the handgun brace of FIG. 1.
Figure 5A:
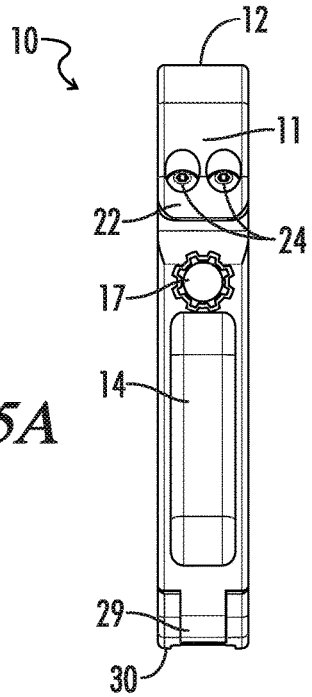
FIG. 5A is a left side elevational view of the handgun brace of FIG. 1.
Figure 5B:
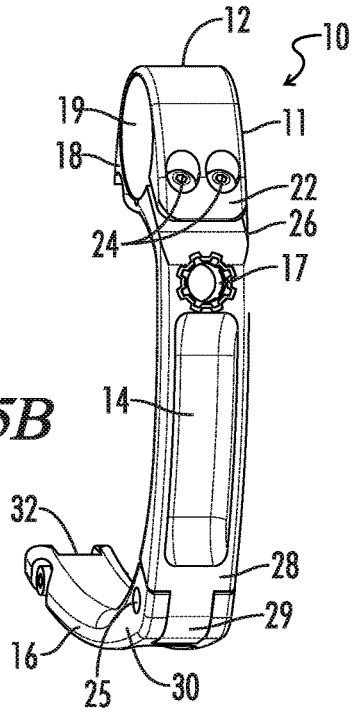
FIG. 5B is a perspective view of the handgun brace of FIG. 5A.
Figure 6A:
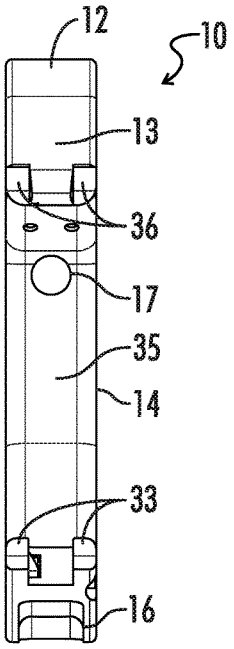
FIG. 6A is a right side elevational view of the handgun brace of FIG. 1.
Figure 6B:
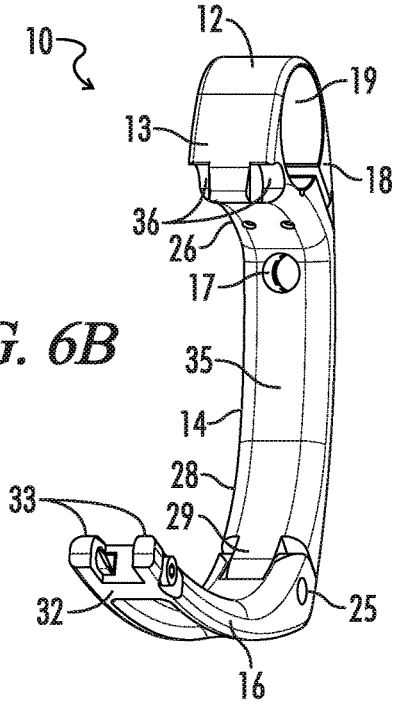
FIG. 6B is a perspective view of the handgun brace of FIG. 6A.
Figure 7A:
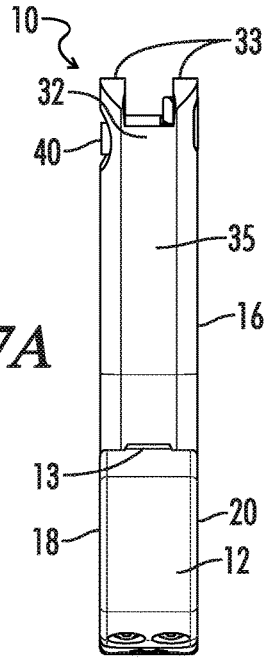
FIG. 7A is a top plan view of the handgun brace of FIG. 1.
Figure 7B:
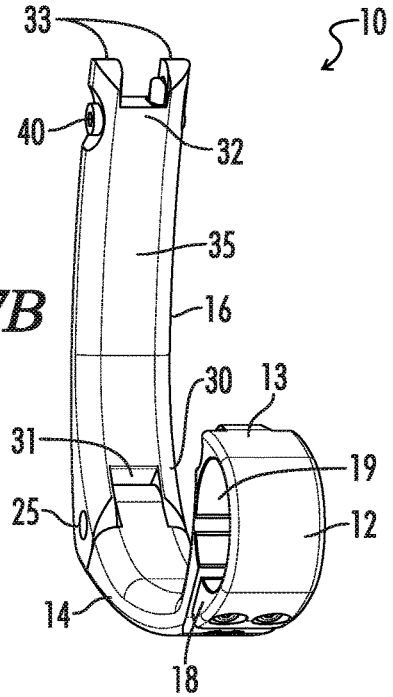
FIG. 7B is a perspective view of the handgun brace of FIG. 7A.
Figure 8A:
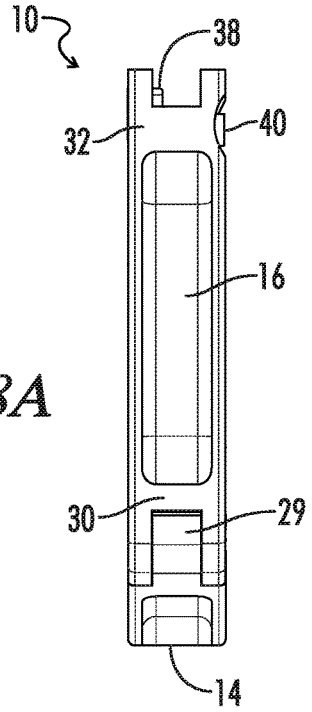
FIG. 8A is a bottom plan view of the handgun brace of FIG. 1.
Figure 8B:
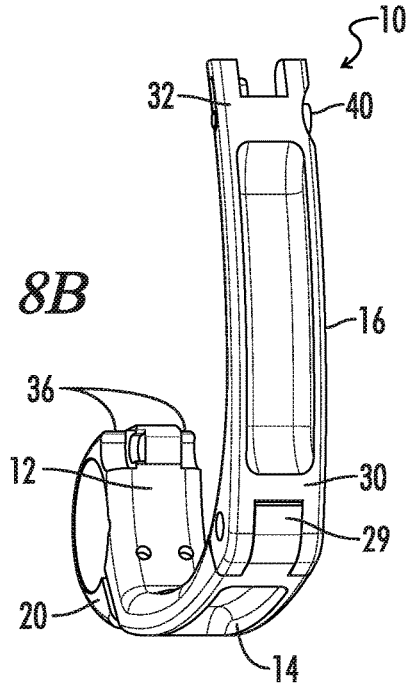
FIG. 8B is a perspective view of the handgun brace of FIG. bA.
Figure 9:
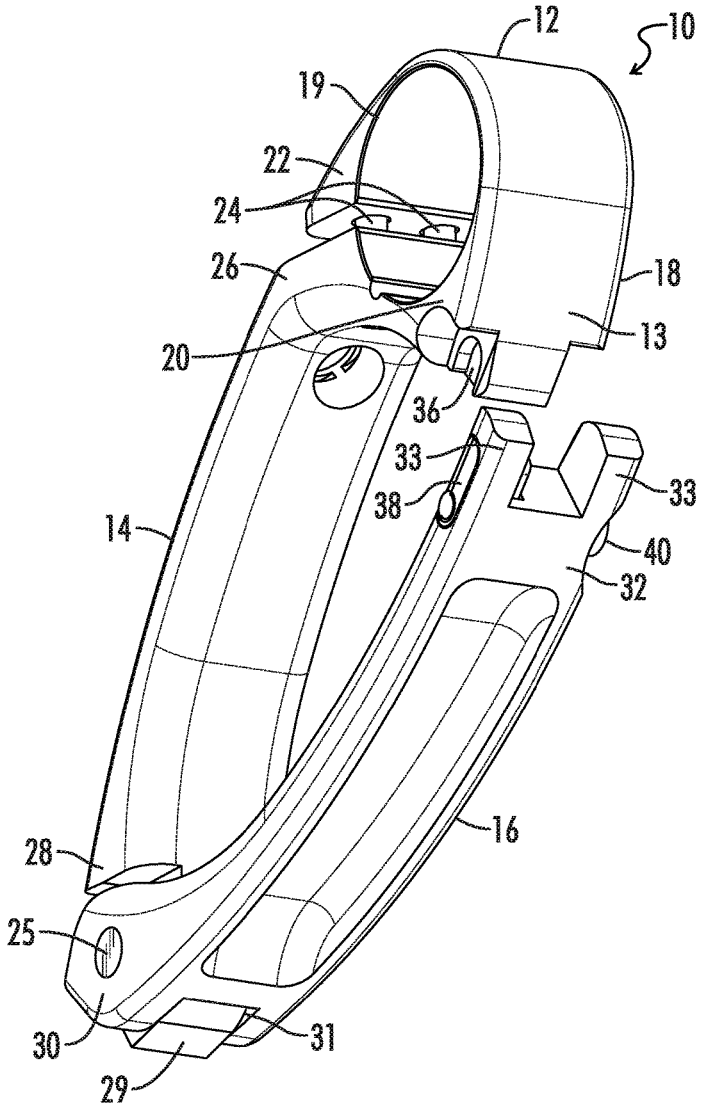
FIG. 9 is a perspective view of the handgun brace of FIG. 1 in a partially closed configuration showing the second arm positioned to be releasably engaged with the body of the handgun brace.

When the second arm 16 is in the open or deployed position, the first and second arms 14, 16 form a forearm support member 34 having a continuous support surface 35 shaped to receive and engage a user's forearm 92. The pivotally connected ends of the first and second arms 28, 30 are shaped such that a portion of the proximal end 30 of the second arm 16 engages a portion of the distal end 28 of the first arm 14 to prevent the second arm 16 from rotating more than about ninety degrees around the pivot pin 25 from the first arm 14, as shown in FIG. 3. This helps the forearm support member 34 to remain downwardly rigid and brace the handgun against the directional forces encountered during use of the handgun.

Specifically, when the user's forearm 92 is received in the forearm support member 34 against the support surface 35, the portion of the forearm support member 34 formed by the second arm 16 is positioned below the user's forearm 92 so that when the downward moment produced by the forward end of an attached front-heavy handgun 90 biases the rear of the handgun 90 and the forearm support member 34 upward against the user's forearm 92, the forearm support member 34 remains rigid to counterbalance the weight of the handgun 90 with the user's forearm 92 and limit upward movement of the rear of the handgun. At the same time, the portion of the forearm support member 34 formed by the first arm 14 is positioned laterally to a side of the user's forearm so that the user's forearm can also assist in preventing lateral rotation of the handgun around the grip in at least one direction. Body 12, which extends laterally over a portion of the user's forearm 92 when the user's forearm is received on the support surface 35, provides an additional counterbalancing force to reduce muzzle flip when the handgun is fired. Thus, in this way, the handgun brace 10 can assist a user in stabilizing a handgun in multiple directions when the user's forearm 92 is received against the support surface 35 of the forearm support member 34.

When the handgun is not in use, the second arm 16 can be moved to the stowed or non-use position to reduce the profile of the handgun brace 10 so that the handgun 90 can be stored more compactly. When the second arm 16 is in the stowed position, the free or distal end 32 of the second arm 16 is received against the side 13 of the body 12 opposite the side 11 from which the first arm 14 extends. The side 13 of the body 12 against which the free or distal end 32 of the second arm 16 is receivable includes two recesses 36, and the distal end 32 of the second arm 16 includes two prongs 33 shaped to engage recesses 36 to retain second arm 16 in the non-use position. The free or distal end 32 of the second arm 16 also includes a selectively releasable fastening mechanism operable to lock prongs 33 in recesses 36 and thus retain second arm 16 in the stowed position when the handgun brace 10 is not in use. As more clearly shown in FIGS. 9 and 10, the fastening mechanism is a push button release including a latch bar 38, a spring 39, and a bolt 40. Each arm 14, 16 can also include a sling loop 27 defined through a portion of the arm in which a sling is receivable to assist a user with carrying the handgun brace and an attached handgun.

The body 12 of the handgun brace 10 can also include a limited rotation quick detach sling swivel socket 17 which can receive and engage a quick detach sling swivel, such as a standard push button release sling swivel. As such, the handgun brace 10 can provide a sling swivel attachment point on a handgun 90 enabling a user to attach a sling to the handgun 90 and thus more easily carry the handgun 90 when the sling is attached to the handgun and positioned about the user's person.

Alternative embodiments are possible and within the scope of the invention. For example, first arm 14 and body 12 can be formed as a single unitary piece, or as separate pieces are subsequently coupled together. Additionally, although the handgun brace 10 is shown in an orientation suitable for a right-handed user, the handgun brace 10 can alternatively be placed in a mirrored configuration such that the handgun brace 10 is suitable for a left-handed user. Alternatively, the handgun brace 10 can be made completely ambidextrous by providing additional recesses 36 in side 11 of the body 12 opposite recesses 36, prongs 33 or other geometry at the proximal end 26 of first arm 14 that can mate with recesses 36 in side 11, and a selectively releasable fastening mechanism operable to releasably lock the proximal end 26 of first arm 14 to the side 11 of the body 12 when the handgun brace is not in use or when the second arm 16 of the handgun brace is in a deployed position.

In other embodiments, the second arm 16 can be pivotally connected to the first arm 14 so that when the second arm 16 is in the stowed position, a rear surface of second arm 16 is received against a front surface of the first arm 14 and the distal end 32 of the second arm 16 is positioned directly below body 12 such that the and first and second arms 14, 16 are vertically parallel.

In additional embodiments, passage 19 can be a blind passage that does not fully extend though body 12 between the front and rear ends 18, 20. Rather, passage 19 can extend though the front end 18 of body 12 and terminate at a position within body 12 proximate to rear end 20. In such case, receiver extension 94 does not extend beyond the rear end 20 of body 12.

In some embodiments, pivot 25 can include a biasing member such as a torsion spring (not shown) which can bias the second arm 16 in either the open or closed position. In some embodiments, the second arm 16 can be biased in the open position, with the torsion spring being placed in either tension or compression as the second arm 16 is moved to the closed position. The engagement of the two prongs 33 and the recesses 36 can resist the biasing force of the torsion spring and retain second arm 16 in the closed position until the user disengages the second arm 16 from body 12. In other embodiments, pivot 25 can be configured so that friction is produced between the first arm 14 and the second arm 16 such that the second arm 16 only rotates with respect to the first arm 14 when the user applies a force to the second arm 16 to overcome the friction. For example, protrusion 29 of first arm 14 can include a circular recess formed around the aperture in protrusion 29 through which pivot pin 25 extends. A rubber o-ring or the like can be disposed in the circular recess such that compression of the o-ring creates smooth friction between first arm 14, second arm 16, and pivot pin 25. As such, second arm 16 can be retained in any position relative to the first arm 14, including both the open and closed positions.

In still other embodiments, handgun brace 10 can include a sear and detent assembly coupled to the first arm 14 and the second arm 16. The sear and detent assembly can be alternated between a first position where motion of the second arm 16 is prevented, and a second position where motion of the second arm 16 is allowed. In some embodiments, the first arm 14 and the second arm 16 can be configured such that the sear and detent assembly can only be placed in the first position when the second arm 16 is in the open position, such that the sear and detent assembly can selectively retain the second arm 16 in the open position.

In another alternative embodiment, handgun brace 10 can be mounted to a light weight handgun such as a GLOCK® brand pistol to dramatically reduce muzzle flip during firing of the handgun. A support structure such as an extension tube can be mounted to a portion of the rear of the handgun, such as the bottom of the grip, so that the extension tube extends rearwardly from the handgun and is receivable in passage 19. The handgun brace 10 can be mounted to the extension tube in an upside down orientation from the orientation depicted in FIG. 1 such that pivot 25 is located above the body 12. As such, when second arm 16 is in the deployed position and a user's forearm 92 is received against support surface 35, the forearm support member 34 is positioned above the user's forearm to provide a counterbalancing force which can prevent the front of the handgun from tilting upward in response to recoil generated by firing the handgun. This can provide increased muzzle control for better target reacquisition and improved successive shot placement as well as reduce the risk of injury and discomfort to physically disabled and novice users resulting from recoil. In such a configuration, body 16 extends laterally under a portion of the user's forearm when the user's forearm is received against the support surface 35. Thus, when the weight of the handgun biases the body 12 upward, the body 16 engages the user's forearm to help support the weight of the handgun. Therefore, arm brace device 10 can be used with light weight handguns to help support the weight of the handgun on the shooter's arm as well as prevent relative motion of the handgun in multiple directions.

Figure 11:
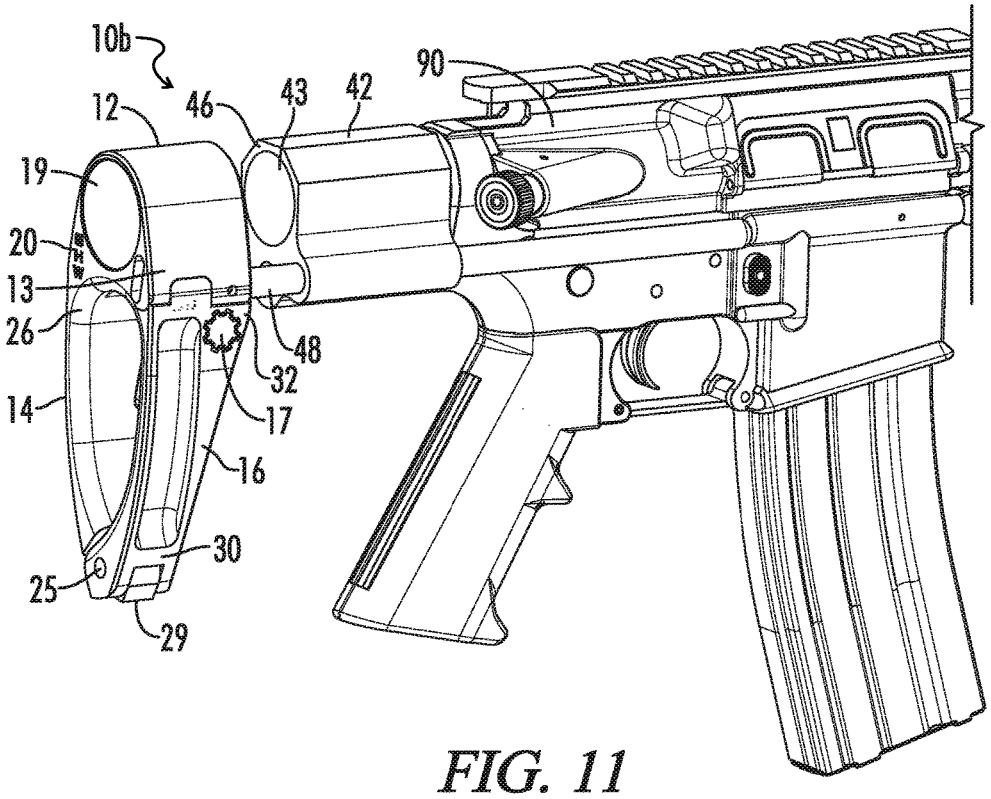
FIG. 11 is a perspective view of a handgun brace constructed in accordance with an alternate embodiment of the present invention showing the handgun brace attached to a handgun and in a compact, non-use configuration.
Figure 12:
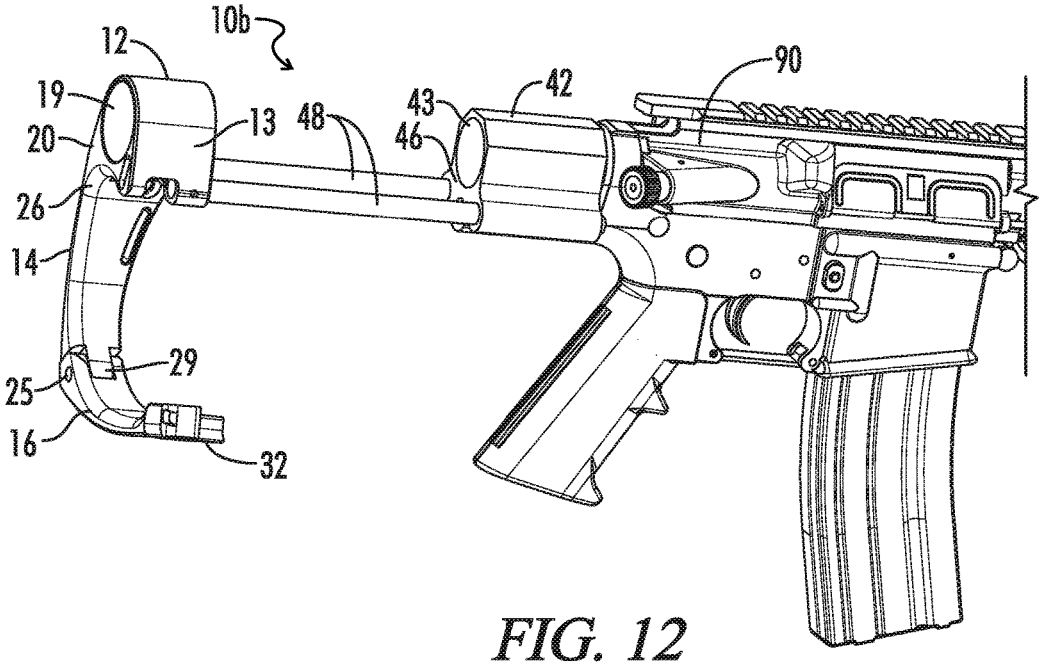
FIG. 12 is a perspective view of the handgun brace of FIG. 11 showing the handgun brace in an extended, deployed configuration.
Figure 13:
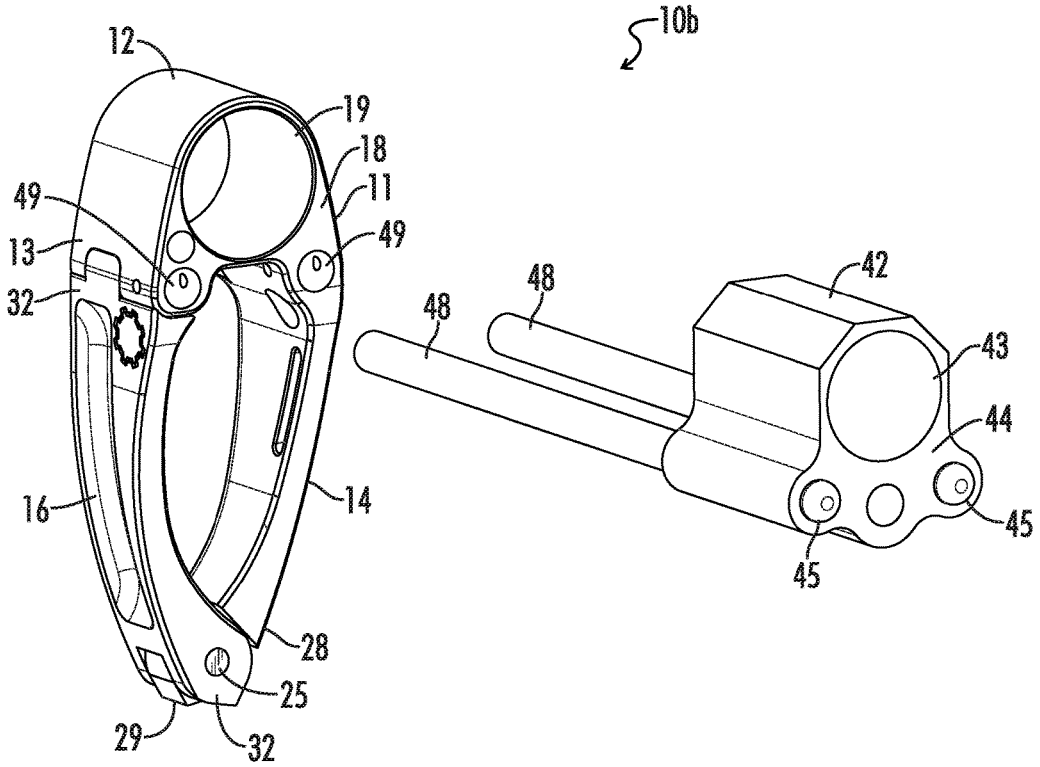
FIG. 13 is a partially exploded front perspective view of the handgun brace of FIG. 11.
Figure 14:
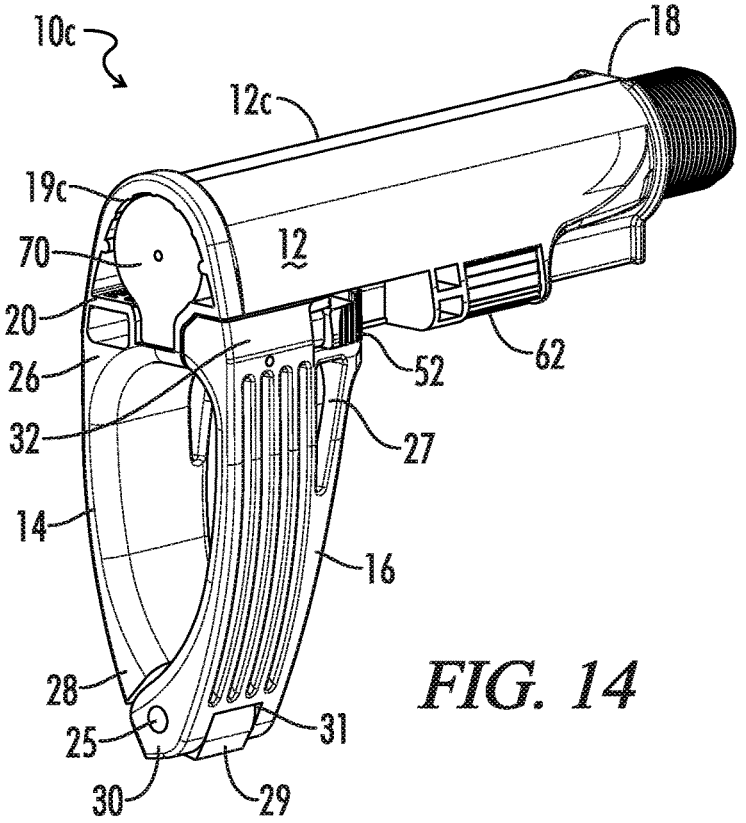
FIG. 14 is a right side perspective view of a handgun brace constructed in accordance with another alternate embodiment of the present invention showing the handgun brace in a non-use configuration.
Figure 15:
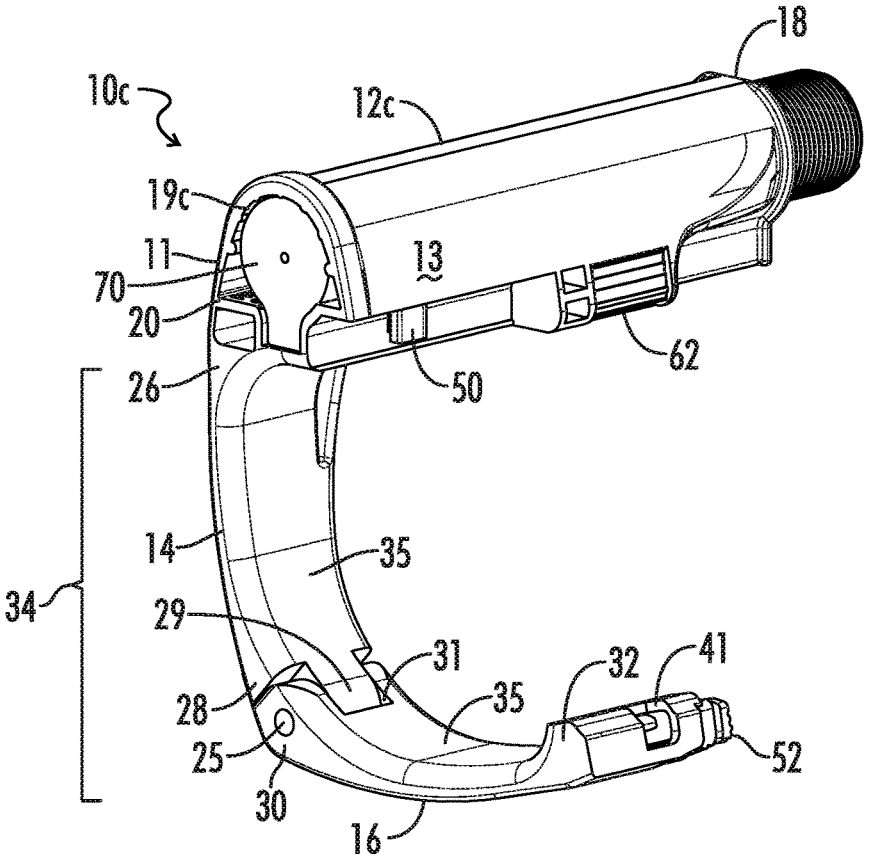
FIG. 15 is a right side perspective view of the device of FIG. 14 showing the handgun brace in a deployed configuration.
Figure 16:
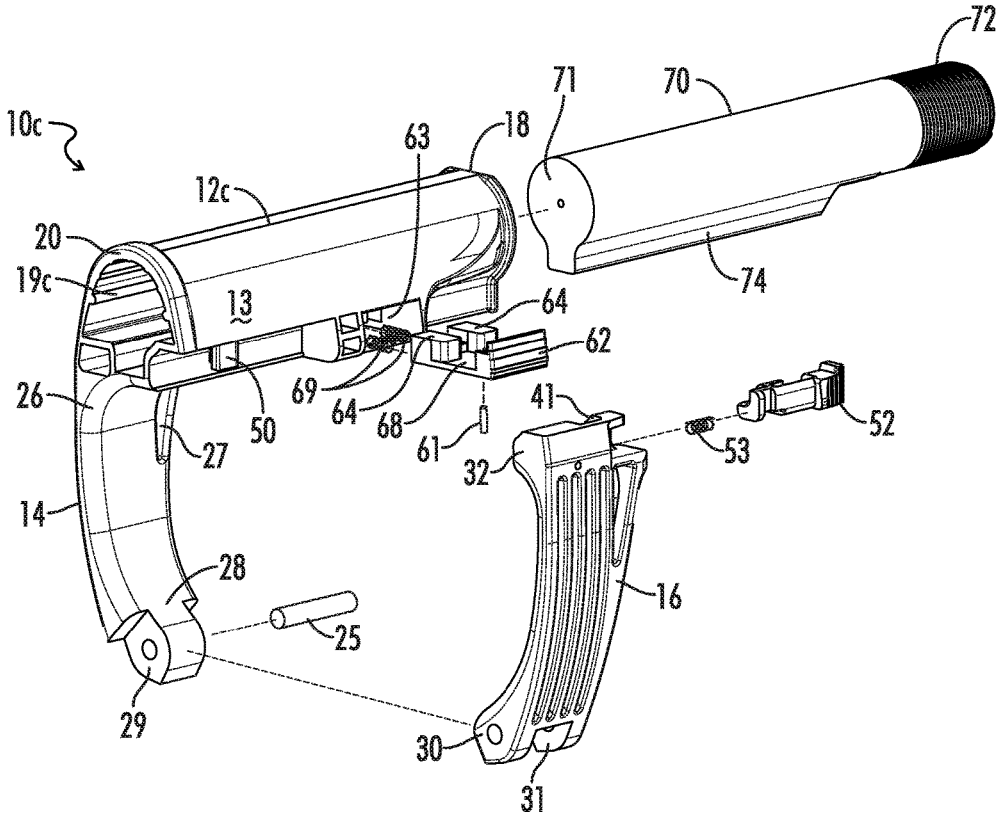
FIG. 16 is an exploded view of the handgun brace of FIG. 14.
Figure 17A:
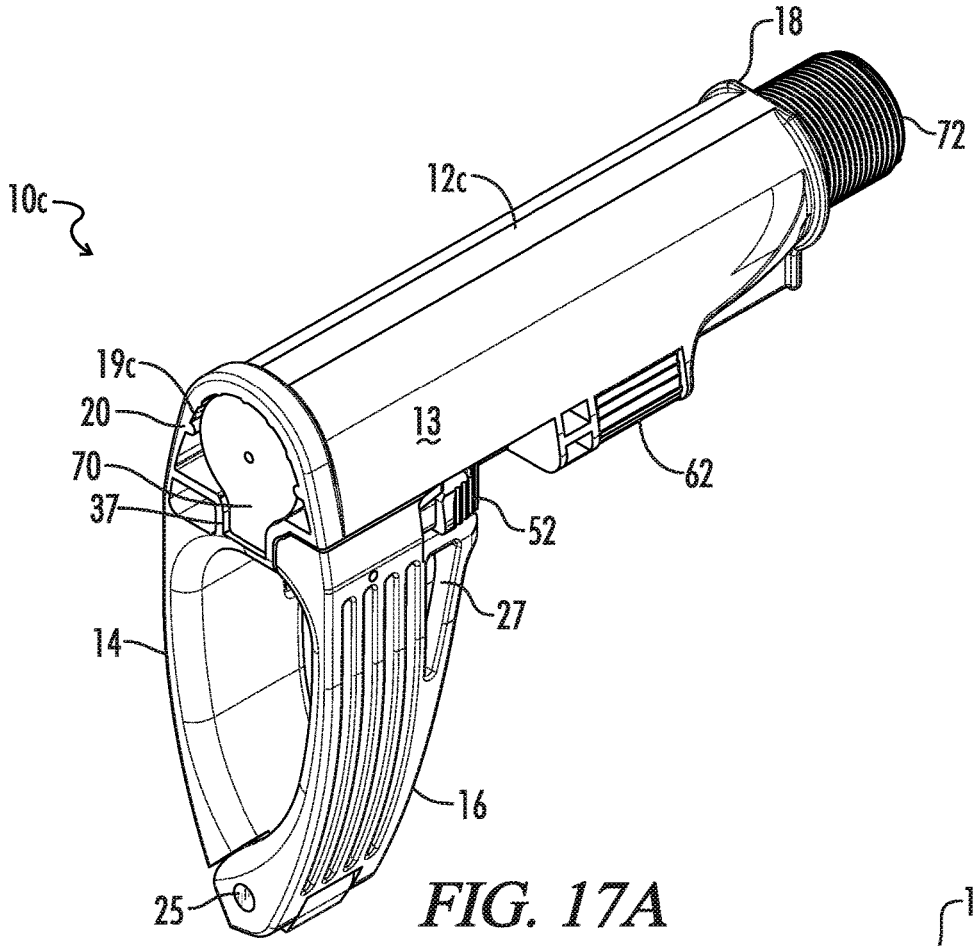
FIG. 17A is a right side perspective view of the handgun brace of FIG. 14.
Figure 17B:
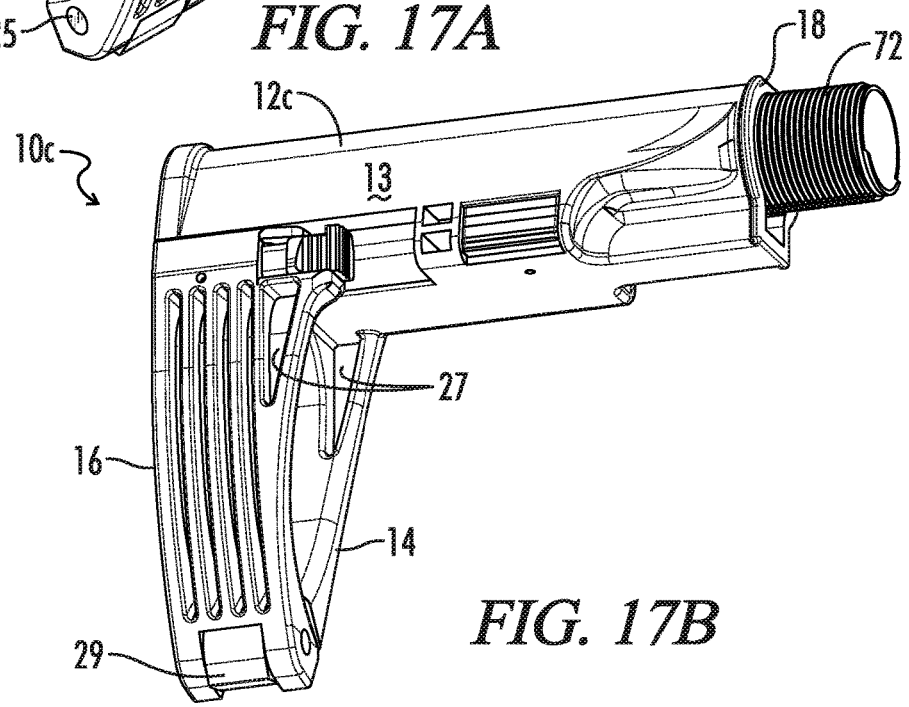
FIG. 17B is another right side perspective view of the handgun brace of FIG. 14.
Figure 18:
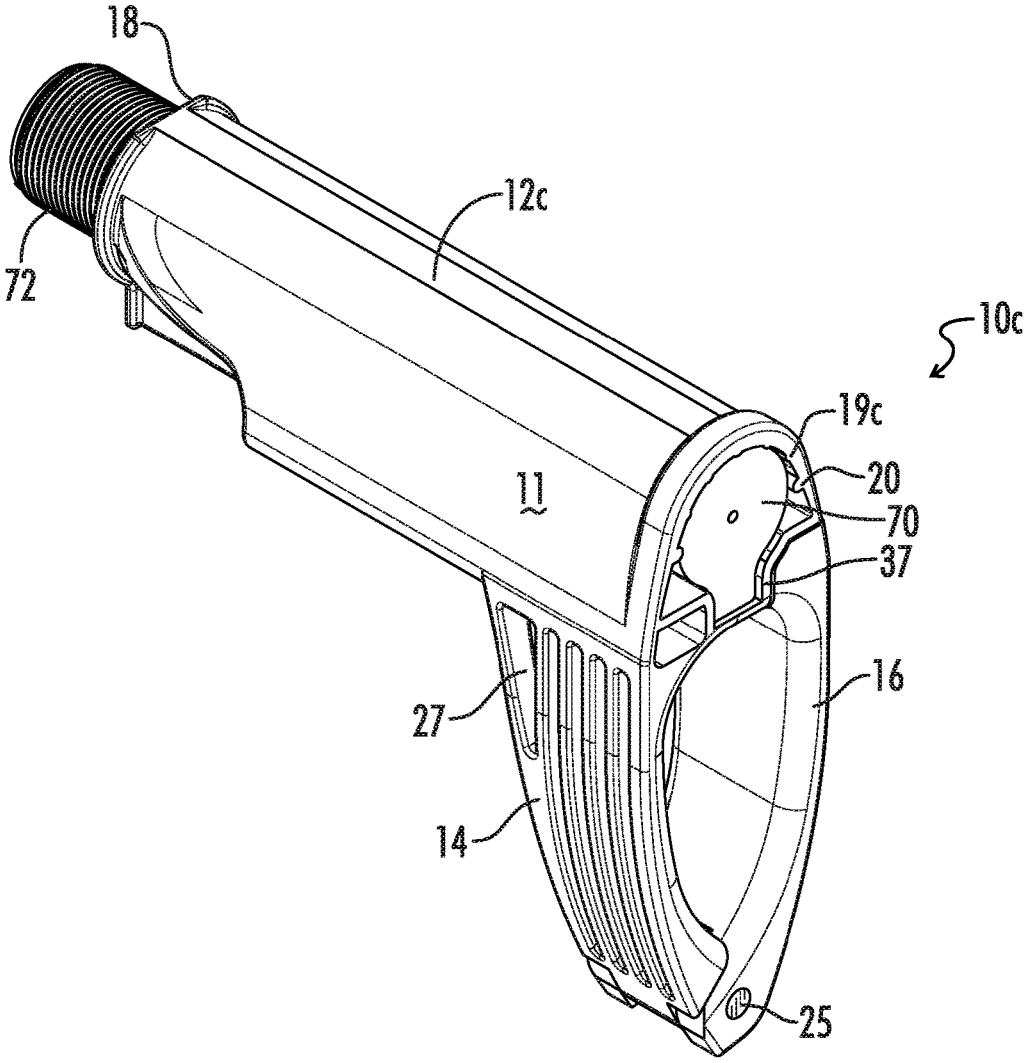
FIG. 18 is a left side perspective view of the handgun brace of FIG. 14.
Figure 19:
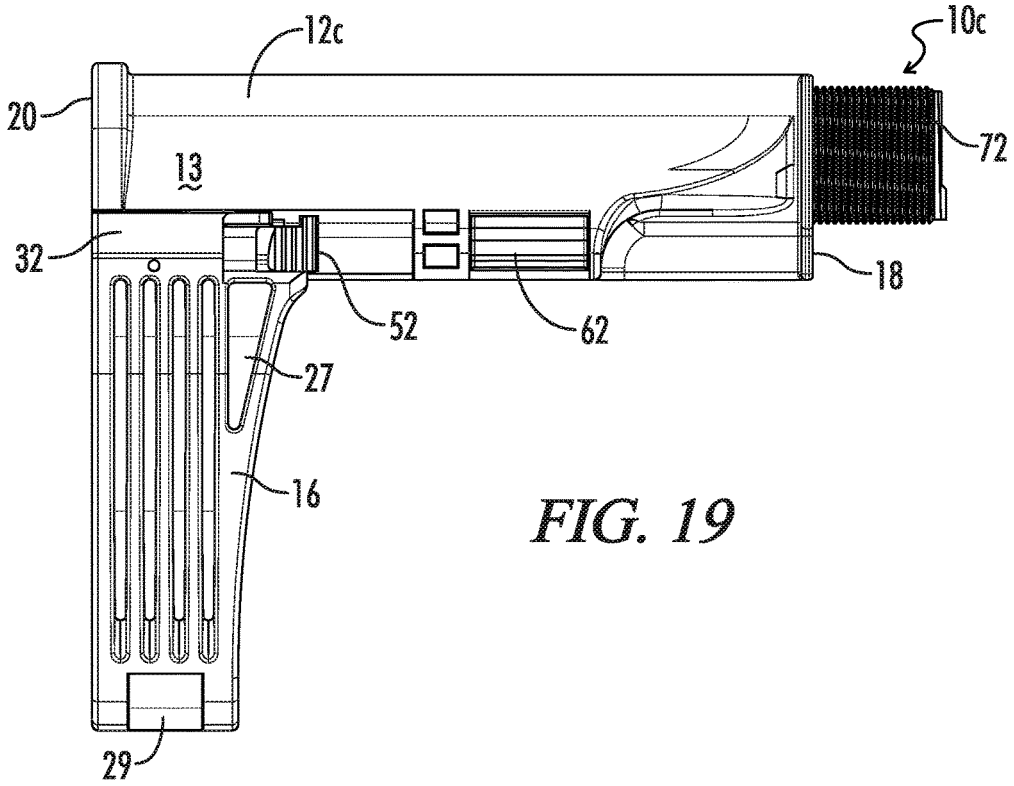
FIG. 19 is a right side elevational view of the handgun brace of FIG. 14.
Figure 20:
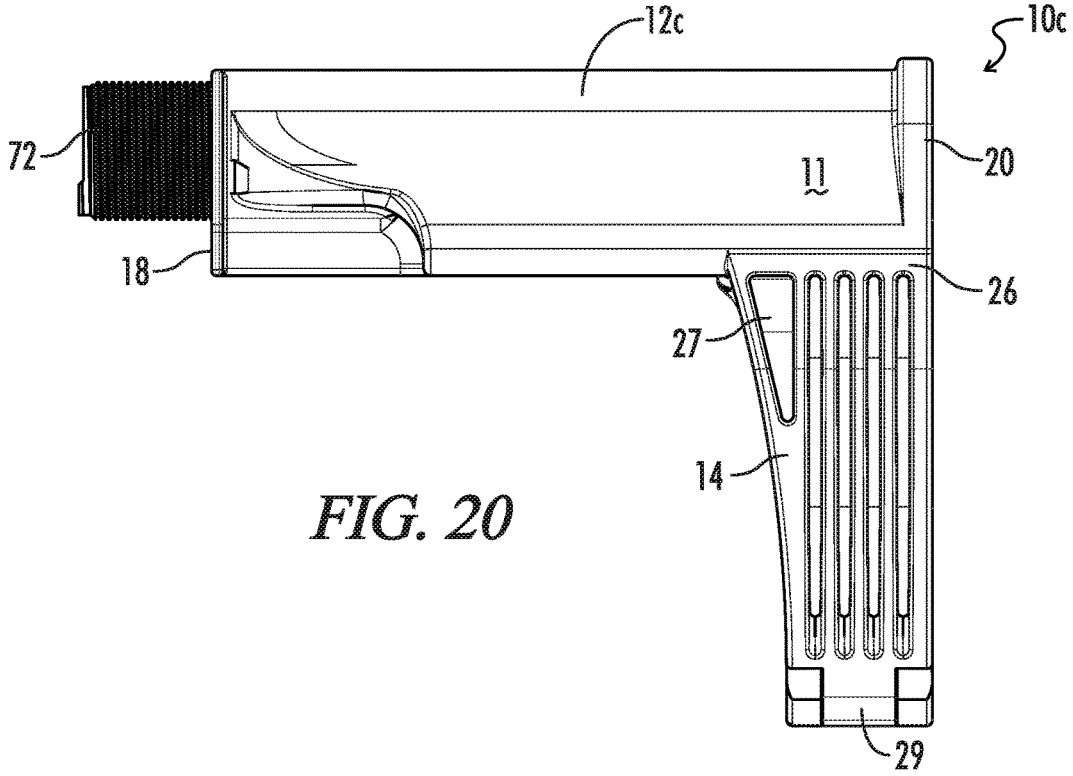
FIG. 20 is a left side elevational view of the handgun brace of FIG. 14.
Figure 21:
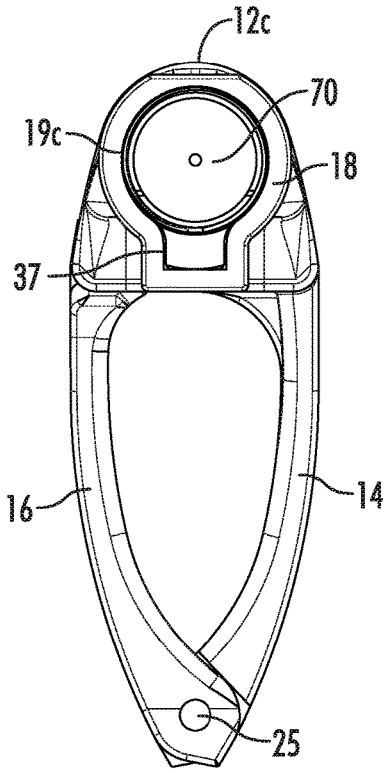
FIG. 21 is a front elevational view of the handgun brace of FIG. 14.
Figure 22:
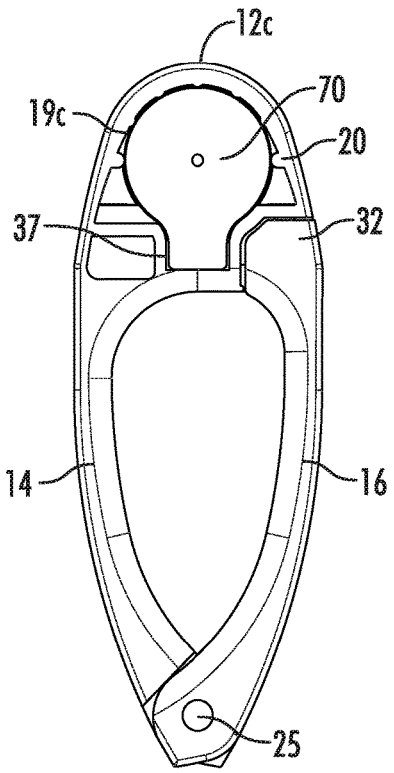
FIG. 22 is a rear elevational view of the handgun brace of FIG. 14.
Figure 23:
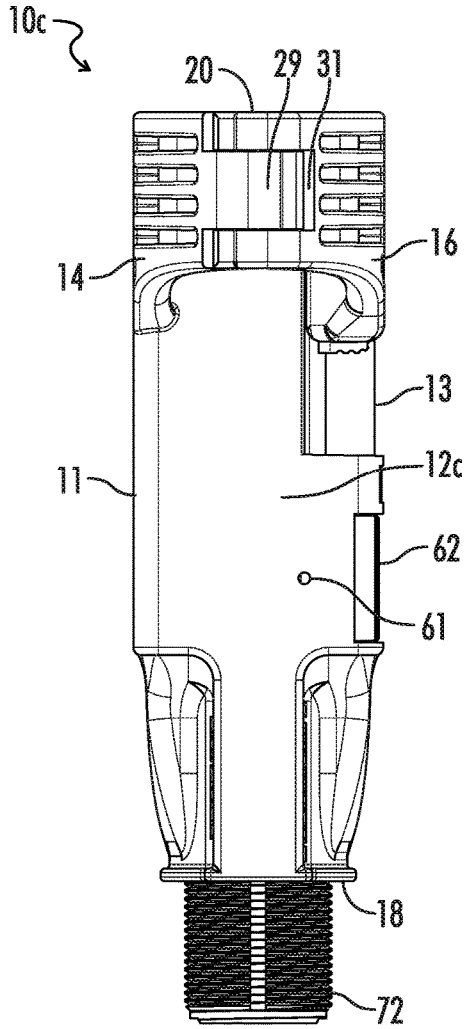
FIG. 23 is a bottom plan view of the handgun brace of FIG. 14.
Figure 24:
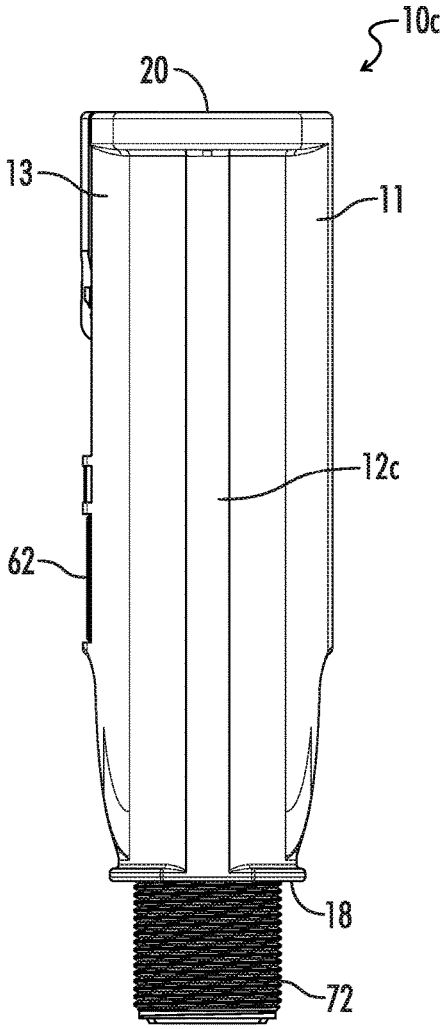
FIG. 24 is a top plan view of the handgun brace of FIG. 14.

Turning now to FIGS. 11 through 13, wherein like reference numerals refer to like elements of previously disclosed embodiments, there is depicted an alternate embodiment of a handgun brace 10*b* constructed in accordance with the present invention. Unlike handgun brace 10, the front end 18 of the body 12 of handgun brace 10*b* includes two laterally opposed recesses 49, each spaced to an opposite side of passage 19. Handgun brace 10*b* further comprises an elongated mounting body 42 having a front end 44, a rear end 46, a main passage 43 extending axially completely through the mounting body between the front end 44 and the rear end 46, two secondary passages 45 that extend axially completely through the mounting body between the front end 44 and the rear end 46, and two support rods 48. The secondary passages 45 are each formed on opposite sides of the main passage 43. Main passage 43 provides for telescopic insertion therein of a handgun support structure such as a receiver extension to secure or mount the mounting body 42 to the handgun as previously disclosed.

Recesses 49 are shaped to receive and engage support rods 48 to secure or mount the body 12 to the support rods 48. Secondary passages 45 in mounting body 42 provide for telescopic insertion therein of support rods 48 to attach body 12 to mounting body 42. Thus, when support rods 48 are received in recesses 49, body 12 can be attached to mounting body 42 by inserting the support rods 94 through secondary passages 45 from the rear end 46 of the mounting body 42. Support rods 18 are frictionally retained in secondary passages 45 and are sized to extend completely though the secondary passages 45 beyond the front end 44 of the mounting body 42. Support rods 48 are axially slidable through secondary passages 45 to permit body 12 to be moved toward or away from the mounting body 42 so a user can adjust the overall length of the handgun brace 10*b*.

Turning now to FIGS. 14 through 41, wherein like reference numerals refer to like elements of previously disclosed embodiments, there is depicted another alternate embodiment of a handgun brace 10*c* constructed in accordance with the present invention. Like handgun brace 10, handgun brace 10*c* comprises a body, a first arcuate arm 14 extending from the body, and a second arcuate arm 16 pivotally connected to the first arm 14. However, body 12*c* omits clamping member 22 and clamp screws 24 of handgun brace 10. Handgun brace 10*c* also substitutes elongated body 12*c* for body 12 of handgun brace 10. Handgun brace 10*c* additionally substitutes protrusion 50 for recesses 36 on side 13 of handgun brace 10, as well as passage 19*c* for passage 19 of handgun brace 10. Passage 19*c*, unlike passage 19 of handgun brace 10, includes a channel 37 extending longitudinally along the bottom of the passage within body 12*c*. In some embodiments, passage 19*c* can extend longitudinally completely through the body 12*c* between the front end 18 and the rear end 20. In other embodiments, passage 19*c* can be a blind passage extending within the body 12*c* through front end 18 and terminating at a position within the body 12*c* proximate to but forward of rear end 20.

Figure 27:
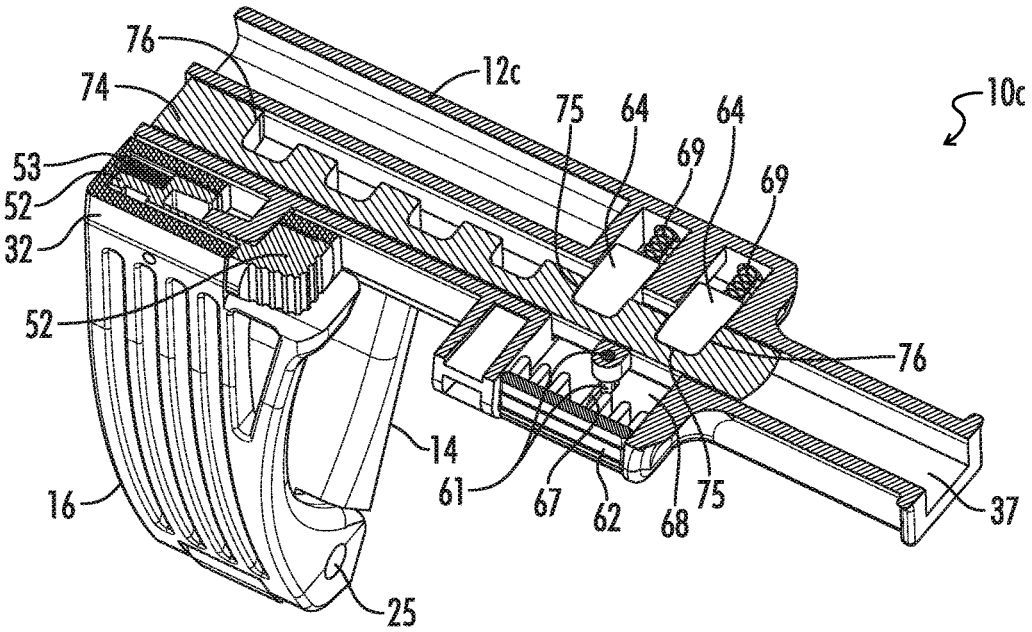
FIG. 27 is a sectional view of the handgun brace of FIG. 14 showing the push button arm release in an unlocked position and the latch in a locked position.
Figure 28:
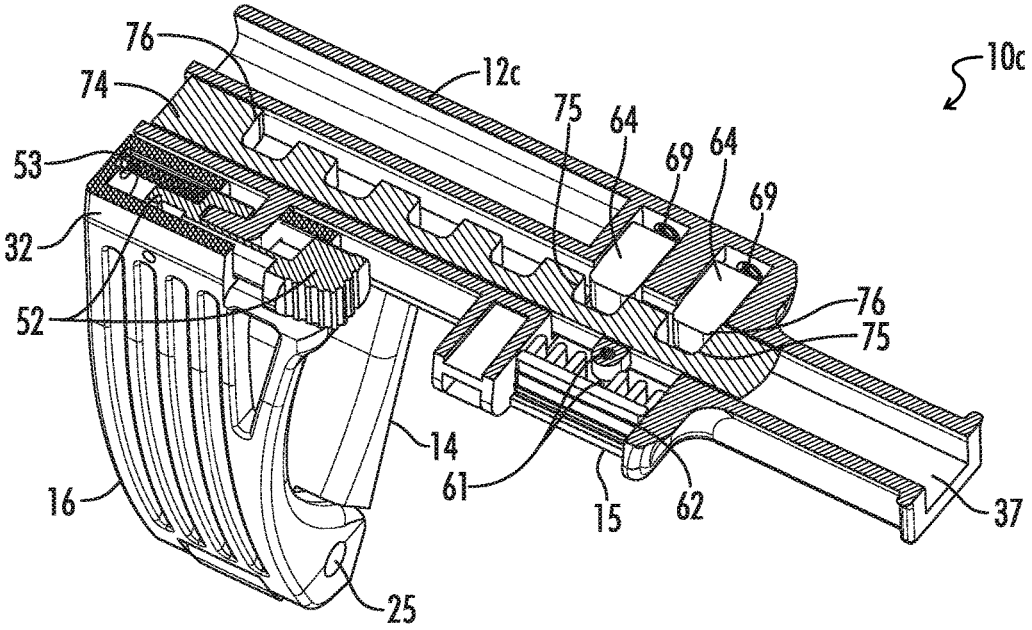
FIG. 28 is a sectional view of the handgun brace of FIG. 14 showing the push button arm release in a locked position and the latch in an adjustment position.

Additionally, the prongs 33 included on the distal end 32 of second arm 16 of handgun brace 10 are omitted from the second arm 16 of handgun brace 10*c*. Instead, the distal end 32 of second arm 16 of handgun brace 10*c* includes an aperture 41 in which protrusion 50 of body 12*c* is receivable, as best shown in FIGS. 27 and 28. The distal end 32 of second arm 16 of handgun brace 10*c* also includes a spring-loaded push button release 52 operable to releasably lock second arm 16 in a stowed position against the side 13 of body 12*c* and thus prevent second arm 16 from being moved into a deployed position when protrusion 50 is received in aperture 41 and spring 53 biases the push button release 52 forward to engage the protrusion 50 as shown in FIG. 28. The second arm 16 can be unlocked and moved into a deployed position upon the application of rearward pressure to the push button release 52 sufficient to compress spring 53 and cause the push button release 52 to disengage the protrusion 50 as shown in FIG. 27.

Figure 25:
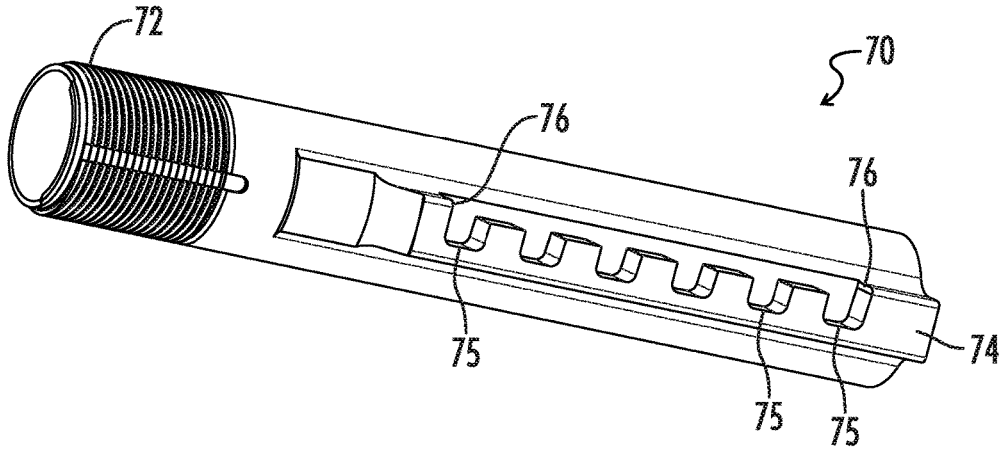
FIG. 25 is a bottom perspective view of an embodiment of a support structure for the handgun brace of FIG. 14.
Figure 26:
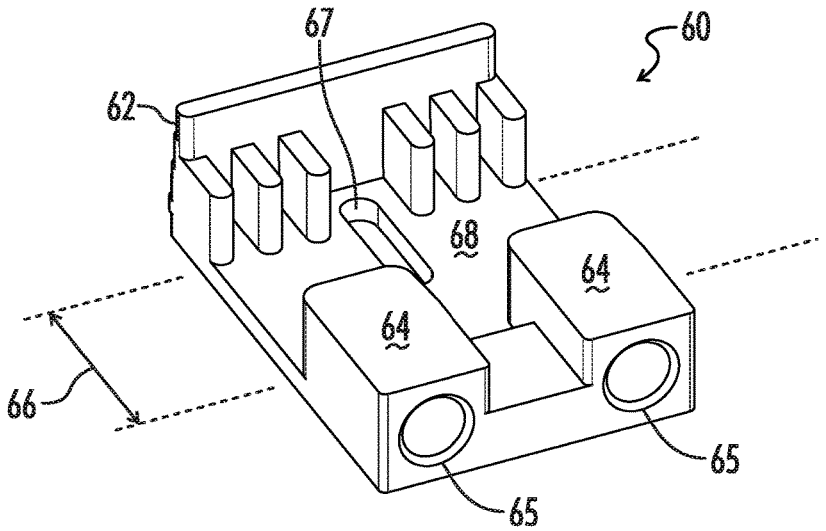
FIG. 26 is a perspective view of an embodiment of a latch for the handgun brace of FIG. 14.

Handgun brace 10*c* also comprises a novel support structure 70 designed to permit a user to telescopically mount body 12*c* of handgun brace 10*c* to a handgun 90. As shown in FIG. 25, support structure 70 includes a generally cylindrical body having a rear end 71 opposite a threaded forward end 72 opposite, and a downwardly projecting rib 74 extending along a portion of the length of the body between the rear end and the forward end 72. Support structure 70 can be attached to any handgun 90 including a native receiver extension 94 in the same way that receiver extension 94 is mountable to handgun 90, namely, by screwing the threaded forward end 72 of support structure 70 into a threaded aperture located in the rear end of the handgun. Body 12*c* is mountable on support structure 70 in the same way that body 10 is mountable on receiver extension 94, namely, by inserting support structure 70 through passage 19*c* from the front end 20 of body 12*c*.

Rib 74 of support structure 70 includes a row of blind cross notches 75 formed in a side of the rib 74. The intervening portions of the rib 74 between each adjacent cross notch 75 are laterally inset from the exterior surface of the side of the rib 74 to form a lip or lug stop 76 at the forward and rearward end of the row of cross notches 75. Cross notches 75 are shaped and dimensioned to preclude insertion of the round locking pin included on currently available telescoping buttstocks for AR-style rifles which attach to such rifles via a receiver extension 94. In this way, the handgun brace 10*c* prevents a user from using support structure 70 to improperly mount a rifle buttstock to the handgun 90, which is prohibited.

Handgun brace 10*c* also comprises a three-stage locking latch assembly selectively moveable between a locked position, an adjustment position, and a removal position. The latch assembly includes a latch 60 which is received in compartment 63 extending laterally through side 13 of body

Figure 29:
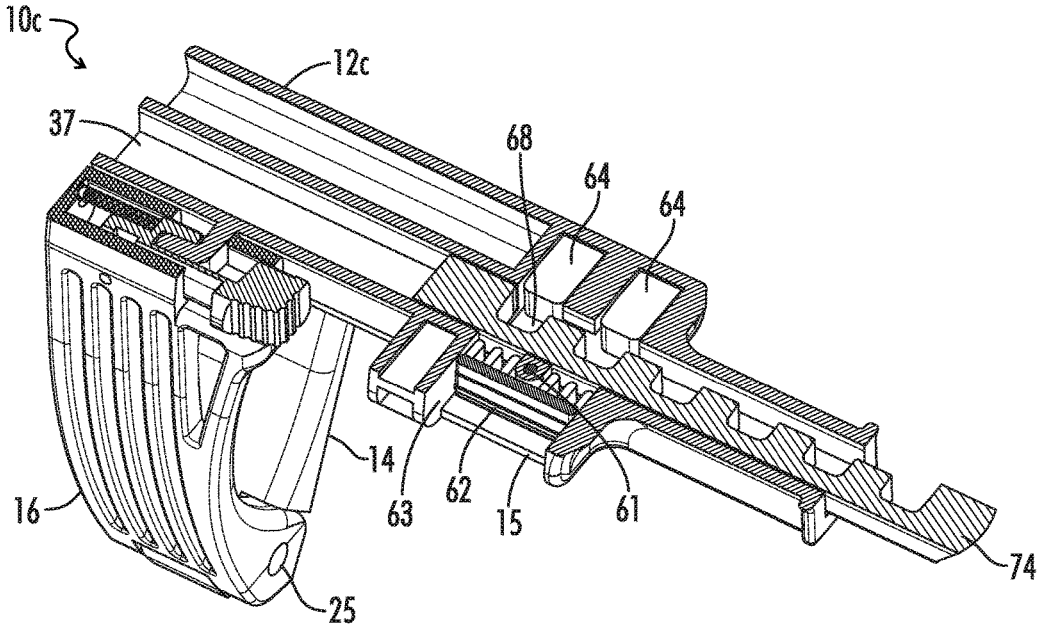
FIG. 29 is a sectional view of the handgun brace of FIG. 14 showing the push button arm release in a locked position and the latch in a removal position.
Figure 30:
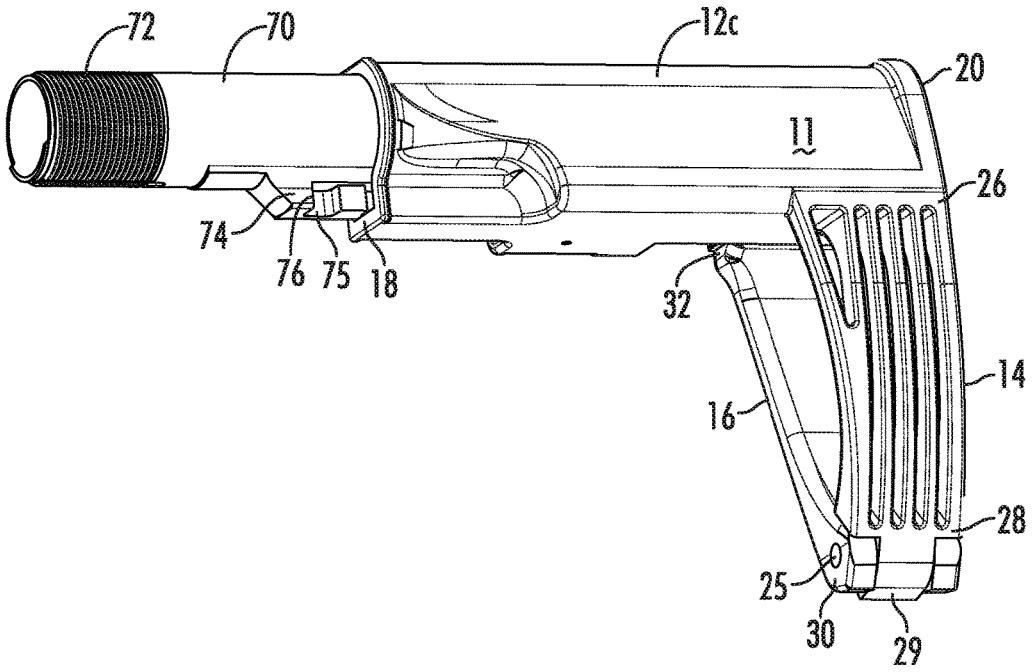
FIG. 30 is another left side perspective view of the handgun brace of FIG. 14.
Figure 31:
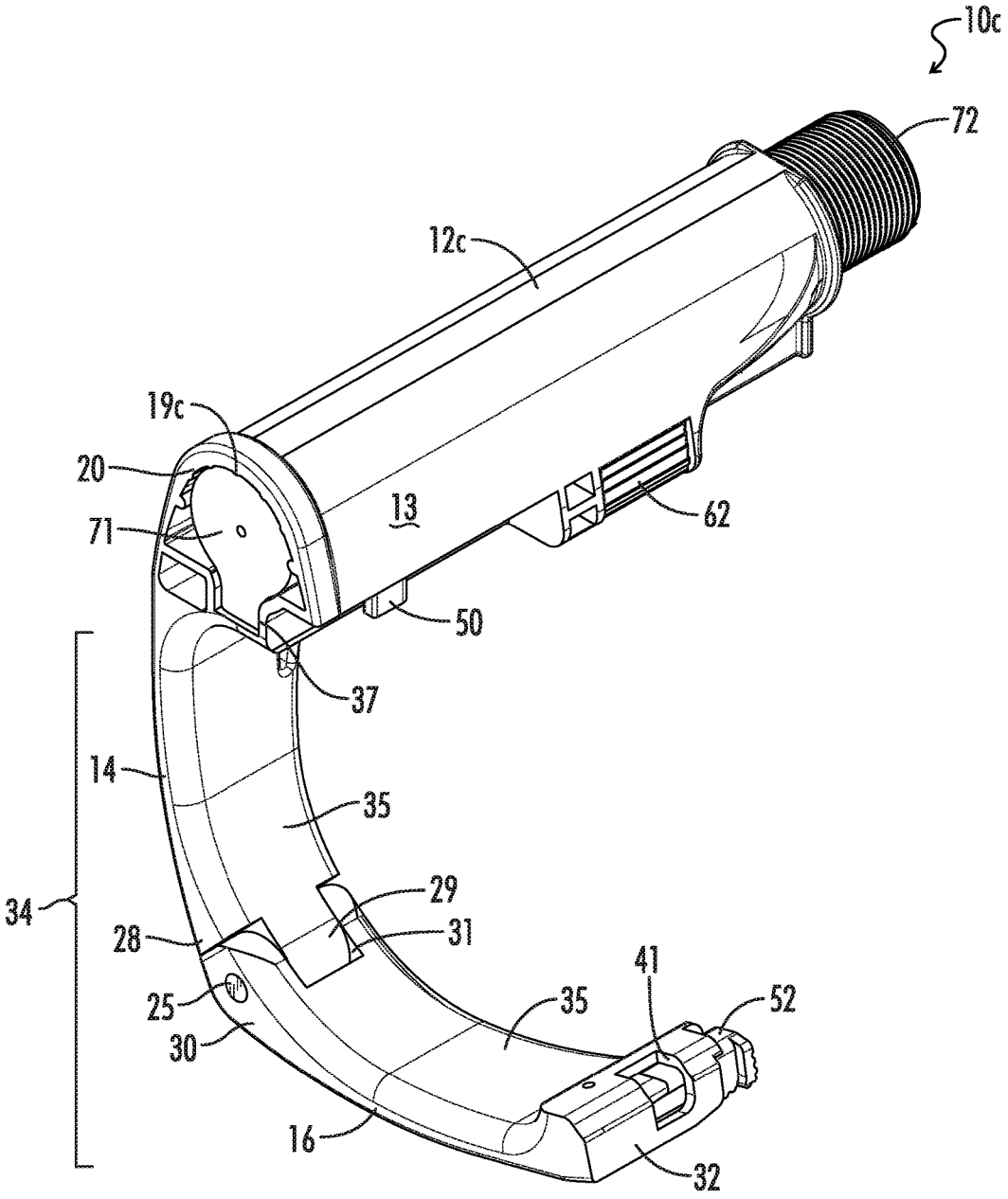
FIG. 31 is a rear right side perspective view of the handgun brace of FIG. 15.
Figure 32:
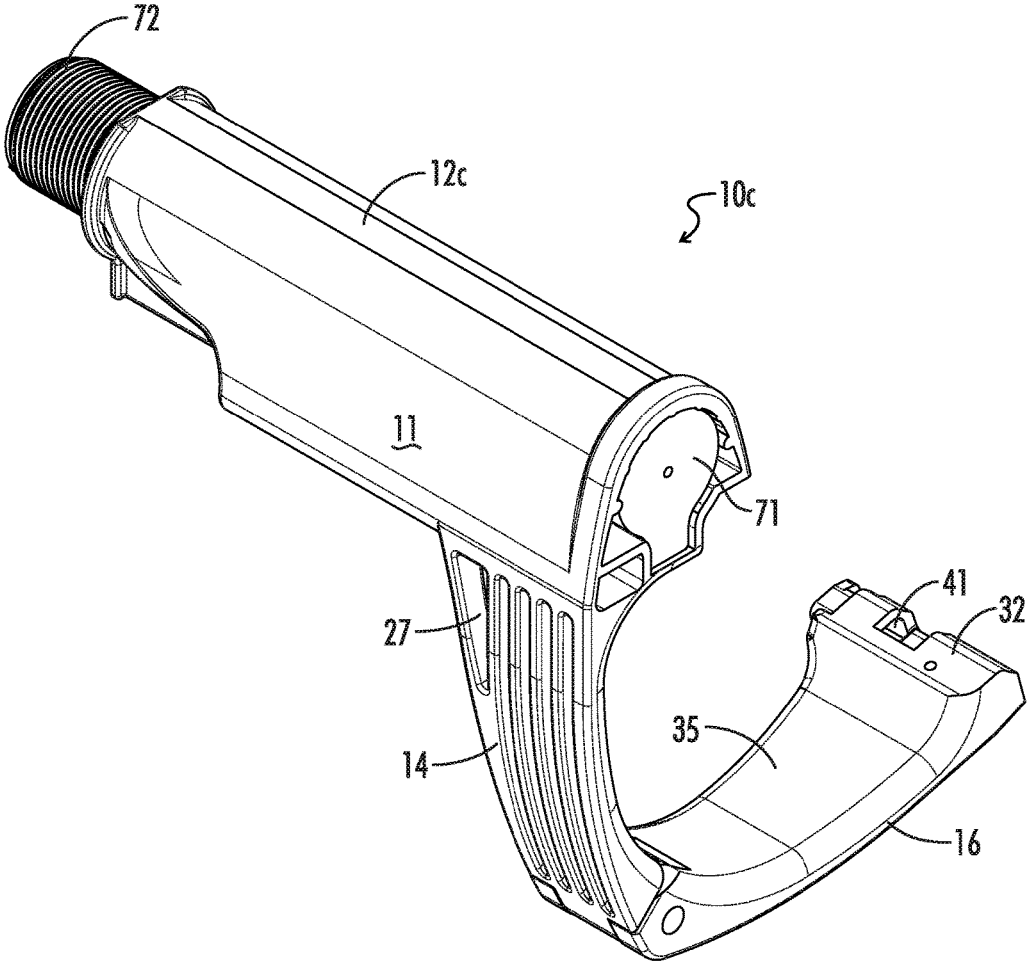
FIG. 32 is a rear left side perspective view of the handgun brace of FIG. 15.
Figure 33:
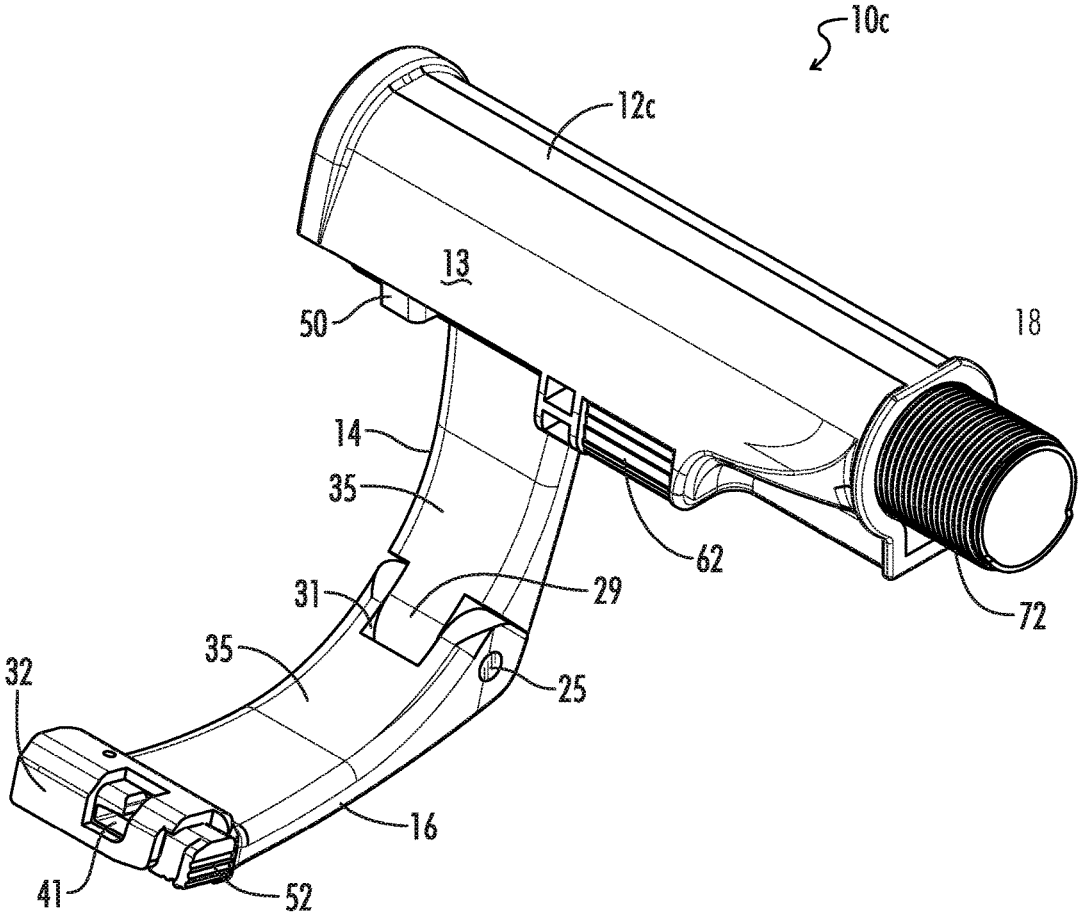
FIG. 33 is a front right side perspective view of the handgun brace of FIG. 15.
Figure 34:
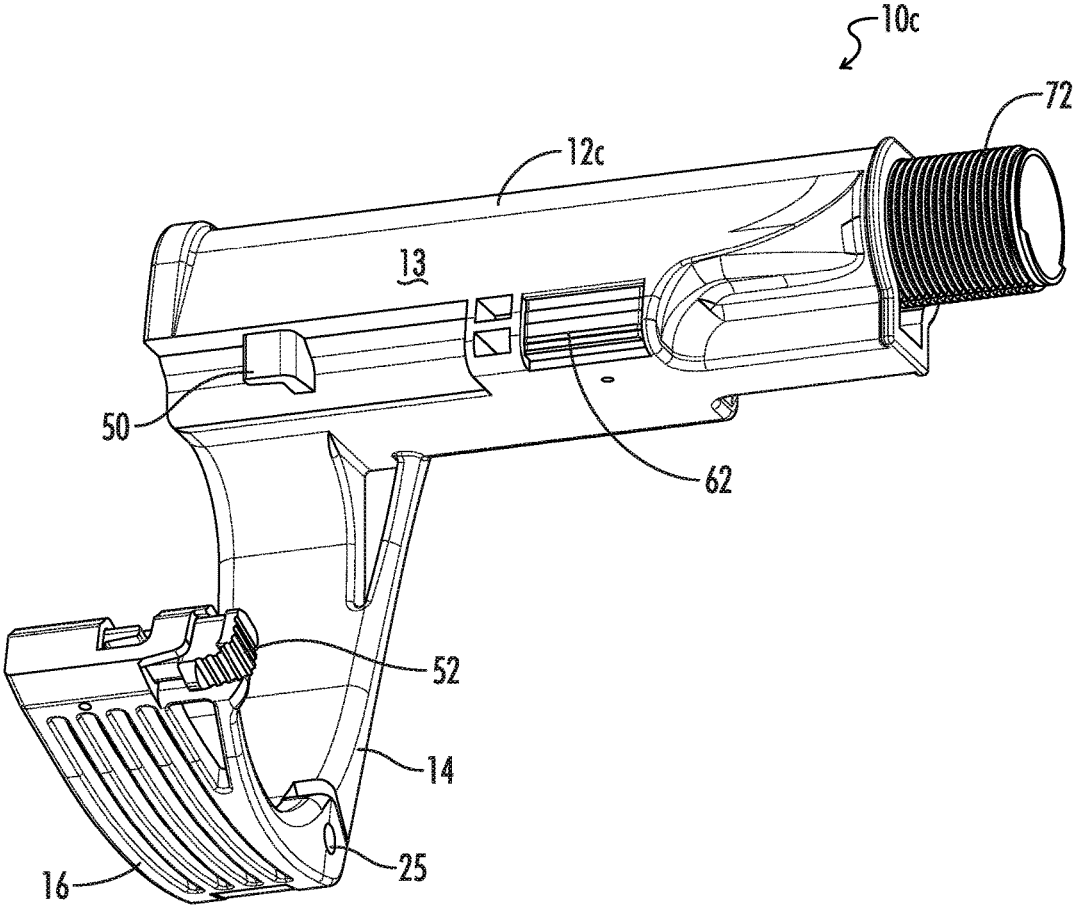
FIG. 34 is a bottom right side perspective view of the handgun brace of FIG. 15.
Figure 35:
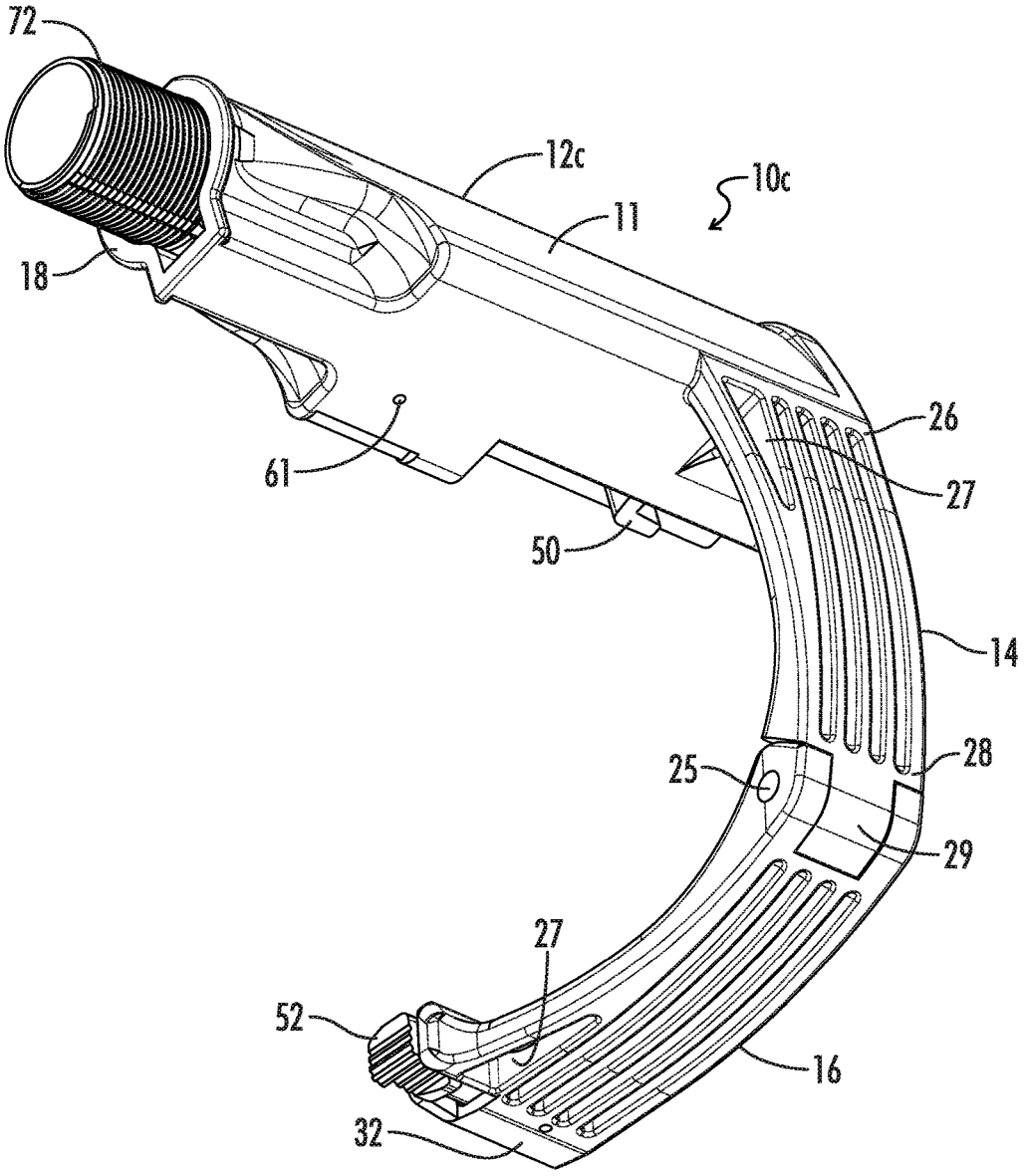
FIG. 35 is a bottom left side perspective view of the handgun brace of FIG. 15.
Figure 36:
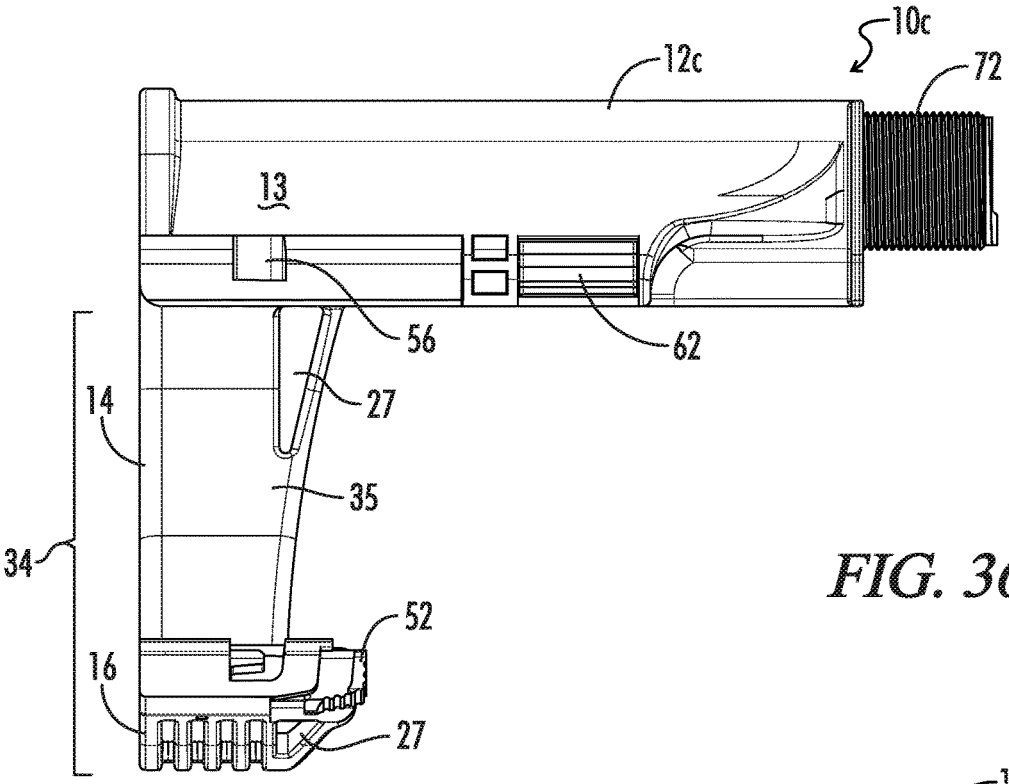
FIG. 36 is a right side elevational view of the handgun brace of FIG. 15.
Figure 37:
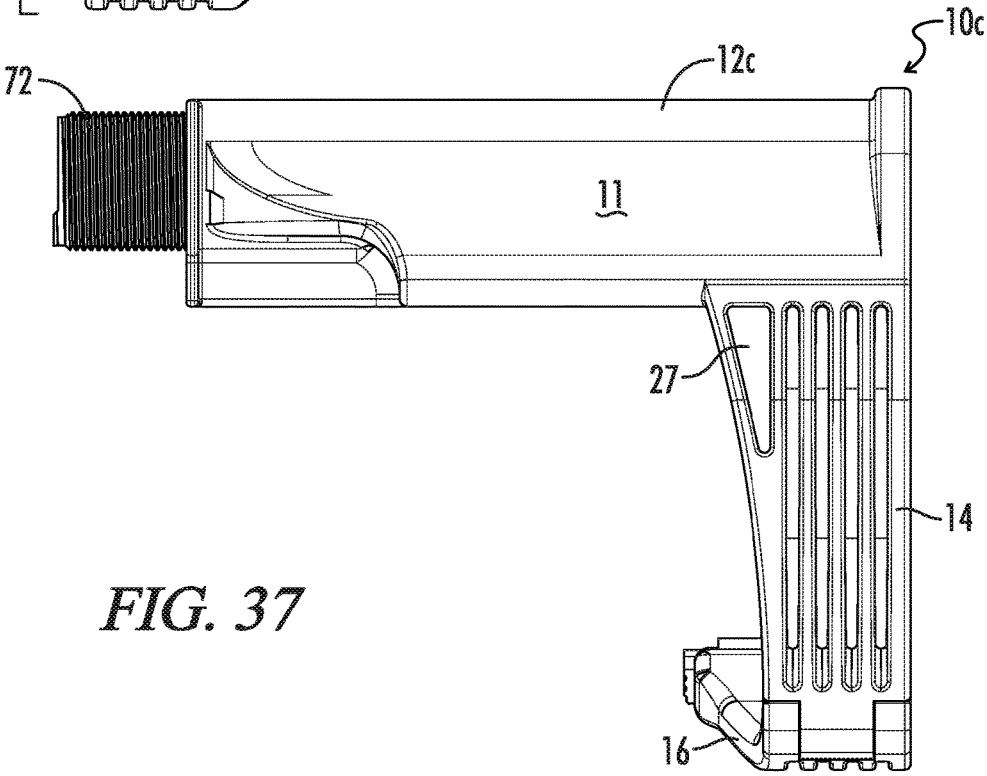
FIG. 37 is a left side elevational view of the handgun brace of FIG. 15.
Figure 38:
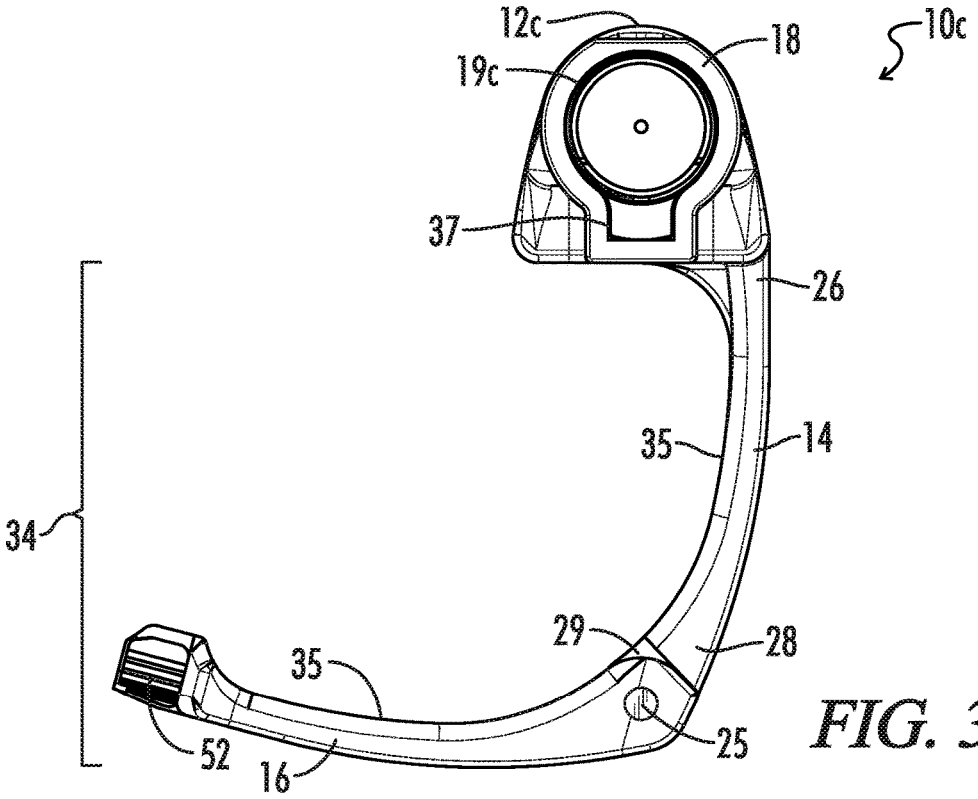
FIG. 38 is a front elevational view of the handgun brace of FIG. 15.
Figure 39:
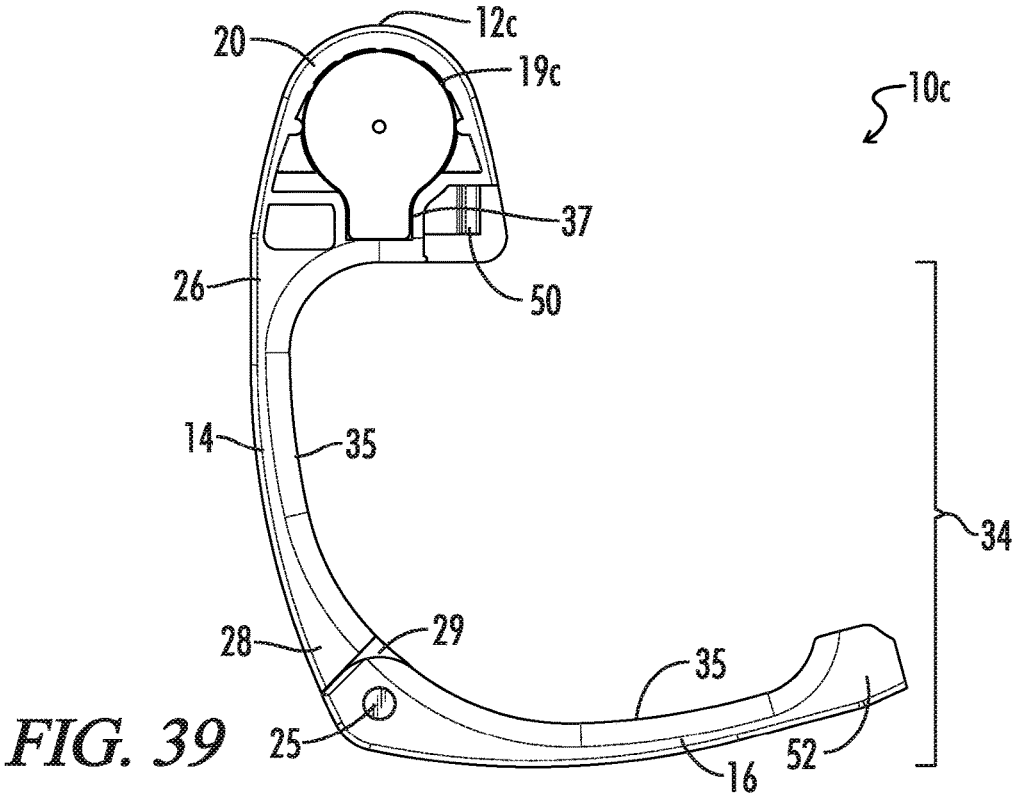
FIG. 39 is a rear elevational view of the handgun brace of FIG. 15.
Figure 40:
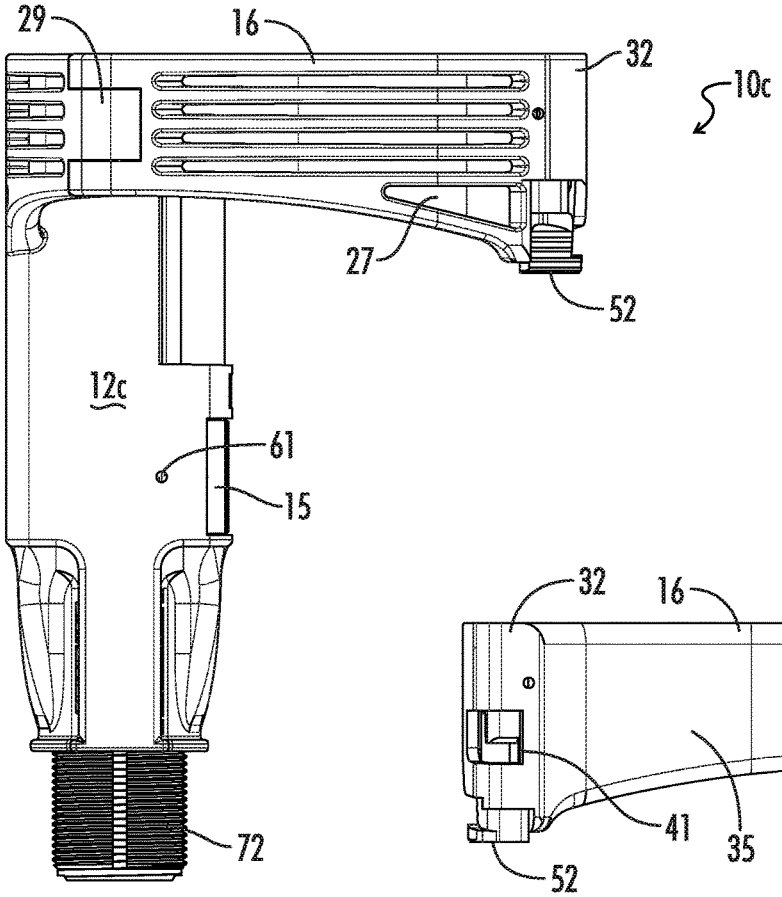
FIG. 40 is a bottom plan view of the handgun brace of FIG. 15.
Figure 41:
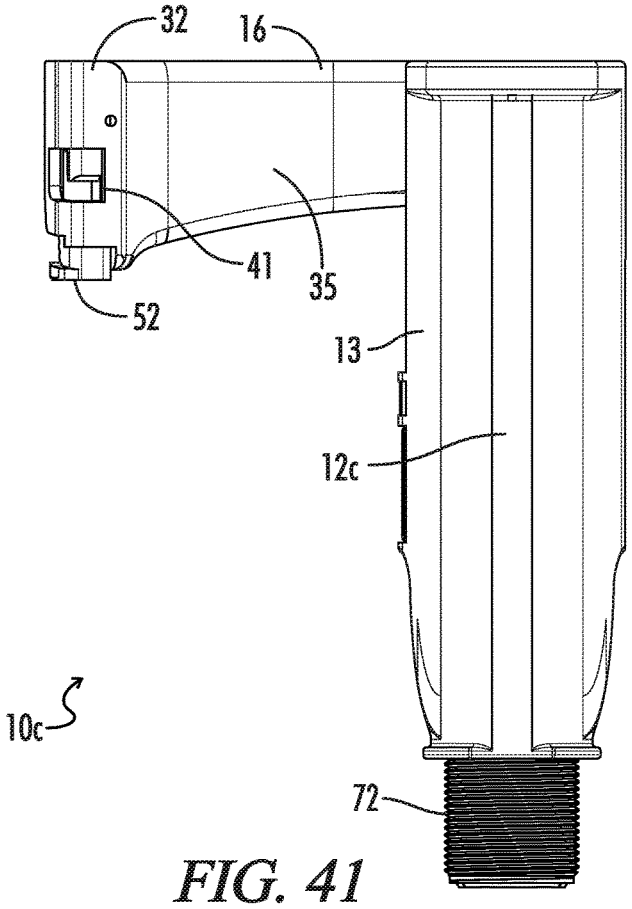
FIG. 41 is a top plan view of the handgun brace of FIG. 15.

12*c* at a location forward of first and second arms 14, 16, a retaining pin 61, and a two detent springs 69. Latch 60 has a thin rectangular base 68, a button face 62 extending upwardly from one end of the base 68, two lugs 64 extending upwardly from the other end of the base 68 opposite the button face 62, and a space 66 between button face 62 and lugs 64. Each lug 64 includes a bore 65 sized to receive a detent spring 69 therein such that when the latch assembly is assembled into body 12*c* as shown in FIGS. 27 through 29, detent springs 69 received in bore 65 contact an interior wall of body 12*c* and bias latch 60 laterally toward side 13. To prevent detent springs 69 from ejecting latch 60 out of body 12*c*, base 68 of the latch 60 includes a retaining pin slot 67 in which retaining pin 61 is received to retain latch 60 inside body 12*c*. Lugs 64 are shaped and sized to be received in and engage the cross notches 75 on rib 74 so as to selectively lock body 12*c* in one of a plurality of preselected positions along the length of rib 74 when support structure 70 is received in passage 19*c*. Space 66 has a width equal to or greater than the width of rib 74 so as to permit rib 74 to slide forward and rearward through the space when the lugs 64 are not engaged with cross notches 75.

As shown in FIG. 27, the latch 60 is in a locked or rest position when the support structure 70 is received in passage 19*c* of body 12*c* and lugs 64 are received in a pair of cross notches 75 in the rib 74. The latch 60 is maintained in a locked position by detent springs 69, which bias lugs 64 laterally to engage cross notches 75 of rib 74 and thus releasably lock body 12*c* in a one of a plurality of preselected positions on support structure 70 so that body 12*c* cannot be removed from support structure 70. When the latch 60 is in the locked position, the button face 62 is flush with the exterior surface of the side 13 of body 12*c* and is ergonomically accessible by a user's thumb.

A user can move the latch 60 into the adjustment position to change the overall length of handgun brace 10*c* by laterally depressing button 62 until the button is flush with recessed ledge or stop 15 defined in the lower portion of side 13 of body 12*c*, as shown in FIG. 28. This disengages lugs 64 from cross notches 75 and frees rib 74 to slide axially through space 66 between button face 62 and lugs 64, enabling the user to move the body 12*c* longitudinally forward or rearward along the support structure 70 to selectively position the body 12*c* at one of a plurality of locations corresponding to a pair of cross notches 75 that suits the user's preference. However, lugs 64 still extend laterally into channel 37 of passage 12*c* far enough that lug stops 76 located at either end of the row of cross notches 75 on rib 74 prevent the body 12*c* from being accidentally removed from support structure 70 while the latch 60 is an adjustment position.

A user can move the latch 60 into the removal position to completely remove the body 12*c* from support structure 70 and disassemble handgun brace 10*c* for storage by laterally depressing button face 62 beyond recessed stop 15, as shown in FIG. 29. When latch 60 is in the removal position, lugs 64 are completely withdrawn from channel 37 and received in internal compartments 79 such that the lugs 64 do not engage cross notches 75 or contact lug stops 76 when the body 12*c* is moved forward or rearward on support structure 70. A user can remove body 12*c* from support structure 70 by sliding body 12*c* rearward off support structure 70 until support structure 70 is withdrawn from passage 19*c*. Body 12*c* can only be removed from support structure 70 while latch 60 in the removal position. The shape, size and lateral movement of button 62 make latch 60 readily accessible and easily operable with a deliberate press with a user's thumb, finger, or prosthesis, while simultaneously reducing the risk of accidental button 62 activation caused by casual interactions with a user's body or the environment. By requiring a deliberation activation, recessed stop 15 prevents unintentional release of body 12*c* from the support structure 70.

In all embodiments disclosed herein, the handgun brace 10 can be made out of a wide variety of strong, durable, rigid materials, including but not limited to, metal, metal alloys, carbon fibers, reinforced polymers, plastics, synthetic polymers, and wood. In some embodiments, body 12 and first and second arms 14, 16 are machined from a metal or a metal alloy such as aluminum or steel, respectively. In other embodiments, body 12 and first and second arms 14, 16 are injection molded out of a polymeric material such as reinforced polymer. In still yet other embodiments, body 12 can be made out of a different material or combination of materials than first and second arms 14, 16. In the embodiment of a handgun brace 10 depicted in FIGS. 1 through 10, the handgun brace 10 is machined from billet aluminum. In the embodiment of a handgun brace 10*c* depicted in FIGS. 14 through 41, the handgun brace 10*c* is injection molded from reinforced polymer.

Thus, although there have been described particular embodiments of the present invention of a new and useful HANDGUN BRACE, it is not intended that such references be construed as limitations upon the scope of this invention.

What is claimed is:

1. A handgun brace for stabilizing a handgun on a user's forearm, the handgun having a support structure extending rearwardly from a rear end thereof, the handgun brace comprising:

a body adapted to detachably engage the support structure of said handgun;

a first arm extending from said body; and a second arm pivotally connected to the first arm, the second arm selectively moveable between a closed position wherein a portion of the second arm is received against a portion of the body forming a closed loop, and a deployed position wherein said second arm pivots away from said main body to form a support surface upon which a user's forearm is removably receivable to stabilize the handgun when said body is engaged with the support structure of said handgun.

2. The handgun brace of claim 1, wherein said body is a lobe configured to receive said support structure therethrough.

3. The handgun brace of claim 2, wherein the lobe comprises a selectively releasable clamping member operable to releasably hold said support structure to attach the handgun brace to said handgun.

4. The handgun brace of claim 1, wherein the body includes a front end, a rear end, and a passage extending axially within the body through at least the front end thereof, said support structure being telescopically receivable by said passage to attach the handgun brace to said handgun.

5. The handgun brace of claim 1, wherein the second arm is pivotally connected to an end of the first arm opposite the body.

6. The handgun brace of claim 1, wherein the portion of the second arm received against the body is an end of the second arm opposite the first arm.

7. The handgun brace of claim 6, wherein the body comprises a recess in which said end of the second arm is removably receivable when said second arm is in the closed position.

8. The handgun brace of claim 6, wherein said end of the second arm comprises a selectively releasable fastening mechanism operable to releasably engage a portion of the body when said second arm is in the closed position.

9. The handgun brace of claim 8, wherein said fastening mechanism is a push button release.

10. The handgun brace of claim 8, wherein the portion of the body engaged by the selectively releasable fastening mechanism is located on a side of the body opposite from the first arm.

11. The handgun brace of claim 1, wherein the second arm is substantially perpendicular to the first arm when the second arm is in the open position.

12. The handgun brace of claim 1, wherein said first arm and said second arm form a downwardly rigid forearm support member sized to receive a user's forearm when said first arm and said second arm are in the open position.

13. The handgun brace of claim 12, wherein said forearm support member defines a space in which a user's forearm is removably received when the support structure is received in the passage and the handgun brace mounted to said handgun.

14. The handgun brace of claim 1, wherein the support structure is a receiver extension or buffer tube.

15. A handgun brace for stabilizing a handgun on a user's forearm, the handgun having a support structure extending rearwardly from a rear end thereof, the handgun brace comprising:

a mounting body having a front end, a rear end, a main passage extending axially within said body through at least the front end thereof, and at least one secondary passage extending axially through said body from said front end to said rear end, the support structure of said handgun being receivable by said main passage;

a main body having a front end, a rear end, and at least one rod extending forwardly from the front end of the main body, said at least one rod being telescopically receivable by said at least one secondary passage of the mounting body; a first arm extending downwardly from said main body; and a second arm pivotally connected to the first arm, the second arm selectively moveable between:

a stowed position wherein a portion of the second arm is received against the main body forming a closed loop, and a deployed position wherein said second arm pivots away from said main body to form a support surface upon which a user's forearm is received during discharge of the handgun while said handgun brace is attached thereto.

16. A handgun brace for stabilizing a handgun on a user's forearm, comprising:

a support structure having a forward end adapted to be detachably engaged with a rear end of a handgun, a rearward end opposite the forward end, a length, and a downwardly protruding rib extending longitudinally along a portion of the length, the rib having a plurality of cross notches formed in a side thereof;

a body having a front end, a rear end, a passage extending axially within the body through at least the front end thereof, said support structure being telescopically receivable by said passage;

a forearm support member including a first arm extending from the body, and a second arm pivotally connected to the first arm, the second arm selectively moveable between a stowed position wherein a portion of the second arm is received against the body to form a closed loop, and a deployed position wherein said second arm pivots away from the body to form a support surface upon which a user's forearm is removably receivable to stabilize the handgun when the rearward end of the support structure is received in said passage and the forward end is engaged with the rear end of said handgun; and a push-button latch extending laterally through a portion of the body, said latch adapted to releasably engage at least one of said cross notches to selectively lock said body in one of a plurality of positions relative to the support structure.

17. The handgun brace of claim 16, wherein said adjustment latch includes a lug, the latch selectively movable between a locked position wherein said lug engages a cross notch to lock said body in one of said plurality of positions, and an adjustment position wherein said lug does not engage a cross notch such that said body is telescopically slidable along support structure.

18. The handgun brace of claim 17, wherein said rib comprises at least one lug stop rearward of the plurality of cross notches, the lug stop configured to contact said lug and prevent removal of the body from the support structure when the latch is in an adjustment position.

19. The handgun brace of claim 16, wherein the forearm support member comprises:

a first arm extending from the body; and a second arm pivotally connected to the first arm, the second arm selectively moveable between a stowed position wherein a portion of the second arm is received against the body, and a deployed position wherein said first arm and said second arm form a support surface upon which a user's forearm is removably receivable.

20. The handgun brace of claim 19, wherein a side of the body comprises a protrusion and the second arm comprises a push button release adapted to releasably engage said protrusion when said second arm is in the stowed position.

* * * * *